US005720261A

United States Patent [19]

Sturman et al.

[11] Patent Number: 5,720,261

[45] Date of Patent: Feb. 24, 1998

[54] VALVE CONTROLLER SYSTEMS AND METHODS AND FUEL INJECTION SYSTEMS UTILIZING THE SAME

[75] Inventors: Oded E. Sturman, 3973 Santa Monica Ct., Newbury Park, Calif. 91320; Christopher North, Camarillo, Calif.; Robert Strom, Thousand Oaks, Calif.; Steven Massey, Camarillo, Calif.

[73] Assignee: Oded E. Sturman, Woodland Park, Colo.

[21] Appl. No.: 348,537

[22] Filed: Dec. 1, 1994

[51] Int. Cl.[6] ..... F02M 51/06

[52] U.S. Cl. ..... 123/446; 123/467

[58] Field of Search ..... 123/446, 467, 123/472, 490, 299, 300, 458, 497, 498, 499; 251/129.1, 12.01; 239/585.4, 88, 90, 92, 96

[56] References Cited

U.S. PATENT DOCUMENTS

| | | |
|---|---|---|
| 1,700,228 | 1/1929 | Kendall . |
| 2,912,010 | 11/1959 | Evans . |
| 2,930,404 | 3/1960 | Kowalski . |
| 2,934,090 | 4/1960 | Kenann et al. . |
| 2,946,513 | 7/1960 | Sampietro . |
| 2,967,545 | 1/1961 | Schmidt . |
| 3,368,791 | 2/1968 | Wells . |
| 3,683,239 | 8/1972 | Sturman . |
| 3,743,898 | 7/1973 | Sturman . |
| 3,821,967 | 7/1974 | Sturman et al. . |
| 3,995,652 | 12/1976 | Belart et al. . |
| 4,046,112 | 9/1977 | Deckard . |
| 4,065,096 | 12/1977 | Frantz et al. . |
| 4,108,419 | 8/1978 | Sturman et al. . |
| 4,114,647 | 9/1978 | Sturman et al. . |
| 4,165,762 | 8/1979 | Acar . |
| 4,182,492 | 1/1980 | Albert et al. . |
| 4,219,154 | 8/1980 | Luscomb . |
| 4,275,693 | 6/1981 | Leckie . |
| 4,279,385 | 7/1981 | Straubel et al. . |
| 4,342,443 | 8/1982 | Wakeman . |
| 4,392,612 | 7/1983 | Deckard et al. . |
| 4,396,037 | 8/1983 | Wilcox . |
| 4,405,082 | 9/1983 | Walter et al. . |
| 4,409,638 | 10/1983 | Sturman et al. . |
| 4,482,094 | 11/1984 | Knape . |
| 4,550,875 | 11/1985 | Teerman et al. . |
| 4,599,983 | 7/1986 | Omachi . |

(List continued on next page.)

FOREIGN PATENT DOCUMENTS

| | | |
|---|---|---|
| 264710 | 1/1950 | Germany . |
| 2209206 | 8/1973 | Germany . |
| 4-341653 | 4/1992 | Japan . |
| 349165 | 5/1931 | United Kingdom . |
| 892121 | 3/1962 | United Kingdom . |

*Primary Examiner*—Carl S. Miller

*Attorney, Agent, or Firm*—Blakely, Sokoloff, Taylor & Zafman LLP

[57] ABSTRACT

The present invention is a fuel injection system having one or more fuel injectors and an electronic control system therefore. The preferred fuel injector has a double magnetic latching solenoid three-way or four-way spool valve that controls the flow of a working fluid that is used to control the discharge of fuel into the combustion chamber or intake manifold of an engine through the nozzle of the injector. The control system provides actuating current pulses to each of the solenoids to actuate and latch the solenoids to effect initiation and termination of the injection. Disclosed are control systems that provide a snap action in one or both actuating directions of the valve by electromagnetically retaining the valve in the latched condition until the force in the actuated solenoid builds to a high level, and then releasing the valve for higher acceleration to the actuated position. Also disclosed is an exemplary control system that senses the arrival of valve at the actuated position so that the actuating current pulse can be terminated as soon as possible so as to allow a strong current pulse drive, but of low total energy, for fast actuation of a relatively small valve. Other embodiments, features and uses of the invention are disclosed.

18 Claims, 16 Drawing Sheets

U.S. PATENT DOCUMENTS 4,605,166 8/1986 Kelly .
4,611,632 9/1986 Kolchinsky et al. .
4,619,239 10/1986 Wallenfang et al. .
4,625,918 12/1986 Funada et al. .
4,648,580 3/1987 Kuwano et al. .
4,741,478 5/1988 Teerman et al. .
4,770,346 9/1988 Kaczynski .
4,785,787 11/1988 Riszk et al. .
4,821,773 4/1989 Herion et al. .
4,979,674 12/1990 Tiara et al. .
5,036,885 8/1991 Mirva .
5,108,070 4/1992 Tominaga .
5,133,386 7/1992 Magee .
5,143,291 9/1992 Grinsteiner .
5,176,115 1/1993 Campion .
5,237,968 8/1993 Miller et al. .
5,251,659 10/1993 Sturman et al. .
5,293,551 3/1994 Perkins et al. .
5,460,329 10/1995 Sturman .
5,463,996 11/1995 Maley et al. .
5,479,901 1/1996 Gibson et al. .

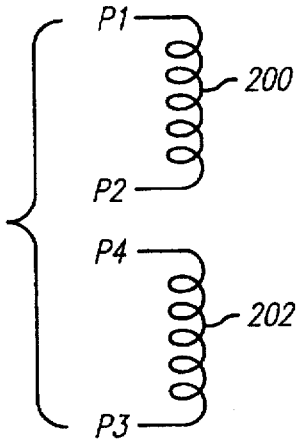
FIG. 9
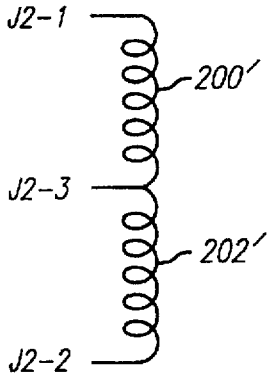
FIG. 13
FIG. 10
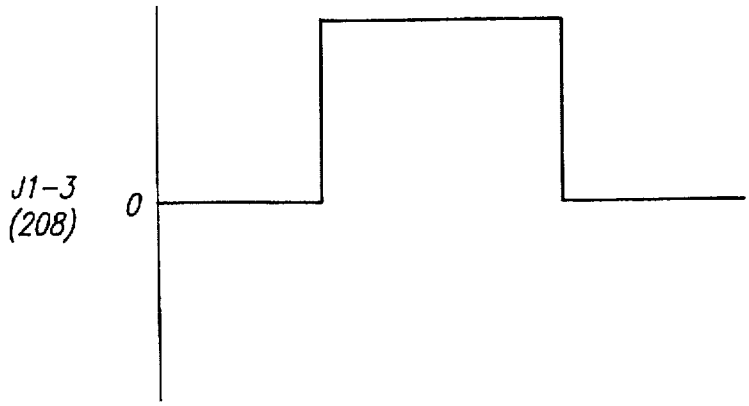
FIG. 11
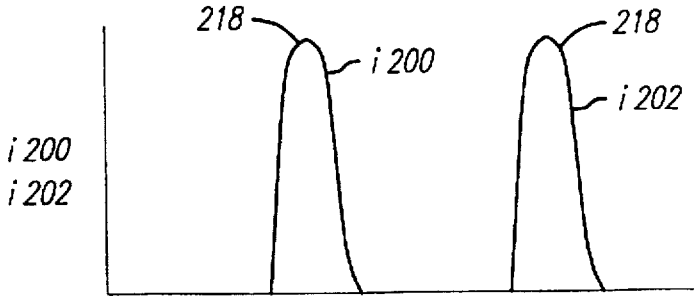

PWR
+5V
GND
U6
206
+5V
C8
C12
C13
C9
306
314
312
U1A
RESET
CLK
DATA
SET
Q
Q̄
316
U4A
IN
+V
S
G
Q2
Q3
R16
R11
R12
R13
R14
R15
C3
320
324
316′
U4B
314′
Q1
Q7
312′
U1B
R6
R1
R2
R3
R4
R5
C1

FIG. 19
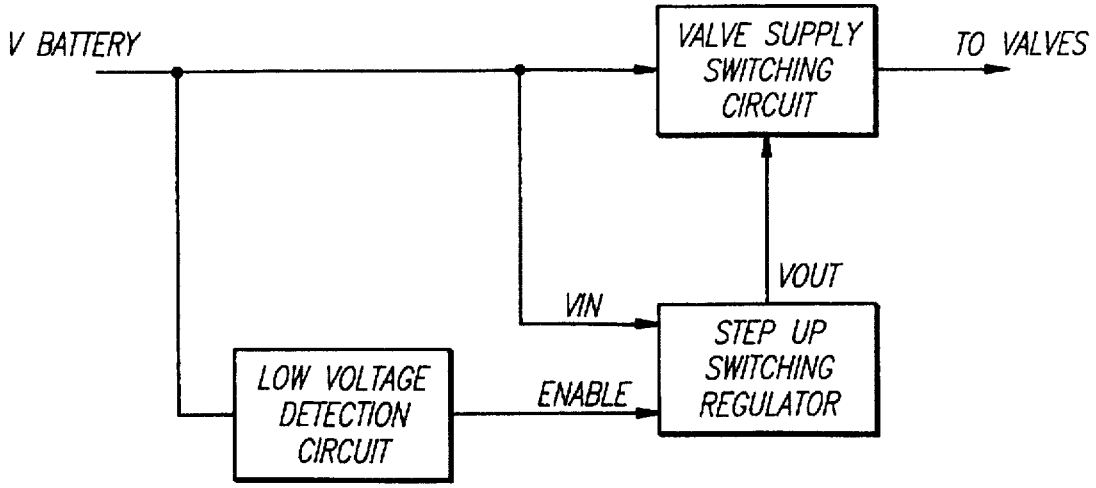
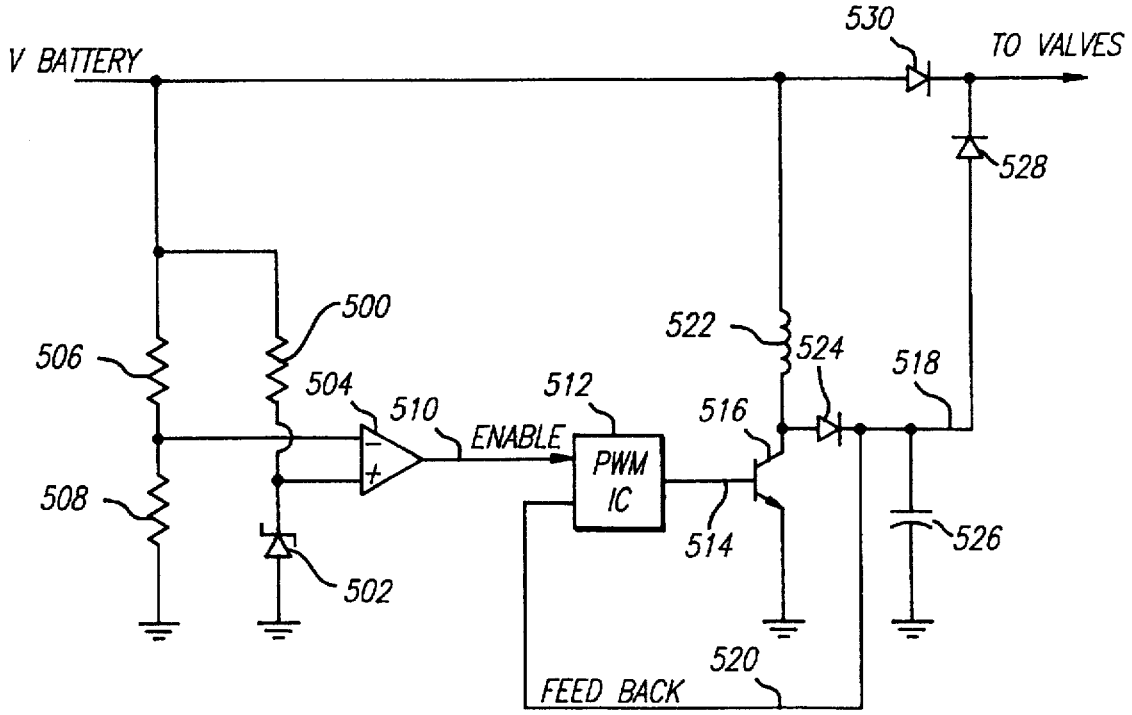
FIG. 20

VALVE CONTROLLER SYSTEMS AND METHODS AND FUEL INJECTION SYSTEMS UTILIZING THE SAME

BACKGROUND OF THE INVENTION (1) Field of the Invention

The present invention relates to the field of valve controllers in systems and methods, and fuel injection systems utilizing the same.

(2) Prior Art

Fuel injectors are used to introduce pressurized fuel either directly into the combustion chamber of an internal combustion engine or, alternatively, into the intake manifold adjacent to the inlet valve of each cylinder. FIG. 1 shows a fuel injection system 10 of the prior art as used for diesel injection directly into the combustion chamber of a diesel engine. The injection system includes a nozzle 12 that is coupled to a fuel port 14 through an intensifier chamber 16. The intensifier chamber 16 contains an intensifier piston 18 which reduces the volume of the chamber 16 and increases the pressure of the fuel therein. The pressurized fuel is released into a combustion chamber through the nozzle 12.

The intensifier piston 18 is stroked by a working fluid that is controlled by a poppet valve 20. The working fluid enters the valve through port 22. The poppet valve 20 is coupled to a solenoid 24 which can be energized to pull the valve into an open position. As shown in FIG. 2, when the solenoid 24 opens the poppet valve 20, the working fluid applies a pressure to the intensifier piston 18. The pressure of the working fluid moves the piston 18 and pressurizes the fuel. When the solenoid 24 is deenergized, springs 26 and 28 return the poppet valve 20 and the intensifier piston 18 back to the original positions.

Spring return fuel injectors are relatively slow because of the slow response time of the poppet valve return spring. Additionally, the spring rate of the spring generates an additional force which must be overcome by the solenoid. Consequently the solenoid must be provided with enough current to overcome the spring force and the inertia of the valve. Higher currents generate additional heat and degrade the life and performance of the solenoid. Furthermore, the spring rate of the springs may change because of creep and fatigue. The change in spring rate will create varying results over the life of the injector.

Conventional fuel injectors typically incorporate a mechanical feature which determines the shape of the fuel curve. Mechanical rate shapers are relatively inaccurate and are susceptible to wear and fatigue. Additionally, fuel leakage into the spring chambers of the nozzle and the intensifier may create a hydrostatic pressure that will degrade the performance of the valve.

The graph of FIG. 3 shows an ideal fuel injection rate for a fuel injector. To improve the efficiency of the engine, it is desirable to pre-inject fuel into the combustion chamber before the main discharge of fuel. As shown in phantom, the fuel curve should ideally be square so that the combustion chamber receives an optimal amount of fuel. Actual fuel injection curves have been found to be less than ideal, thereby contributing to the inefficiency of the engine. It is desirable to provide a high speed fuel injector that will supply a more optimum fuel curve than fuel injectors in the prior art.

As shown in FIGS. 1 and 2, the poppet valve constantly strikes the valve seat during the fuel injection cycles of the injector. Eventually the seat and the poppet valve will wear, so that the valve is not properly seated within the valve chamber. Improper valve seating may result in an early release of the working fluid into the intensifier chamber, causing the injector to prematurely inject fuel into the combustion chamber. It would be desirable to provide an injector valve that did not create wear between the working fluid control valve and the associated valve seat of the injector.

The solenoid 24 of the fuel injector of FIGS. 1 and 2 is a direct pull solenoid operating in opposition to spring 26. This is an advantage over still earlier prior art fuel injectors which were cam operated in that the solenoid operated injectors of FIGS. 1 and 2 may be electronically controlled in timing and duration, unlike the cam operated injectors wherein at least the initiation of injection was typically at a fixed angle of rotation of the crankshaft independent of engine speed or load. The solenoid operated injectors of FIG. 1 and 2 have the disadvantage however, of not being as fast as they could be, and of consuming more power than necessary. In particular, since the solenoids operate in opposition to spring 26, the net force controlling the speed of opening of the poppet valve 20 is not the solenoid force, but rather the difference between the solenoid force and spring force 26, whereas the net force closing the valve is simply the spring force 26, which can only be a fraction of the solenoid opening force for the valve to operate. Accordingly, the full pulling potential of the solenoid is not realized on either opening or closing of the poppet valve. Also, the solenoid must remain energized for as long as the solenoid is actuated, and thus must be of a size and of a heat dissipation capability commensurate with a "full throttle" fuel injection rate. Further, the solenoid pulling force must be adequate to properly operate the valve at the lower extreme of the power supply and upper extremes of solenoid coil resistance, the force of spring 26, etc. while at the same time not overheating at full throttle, upper power supply voltage and low solenoid coil resistance extremes. It is the improvement of performance in this area, among other things, to which the present invention is directed.

BRIEF SUMMARY OF THE INVENTION

The present invention is a fuel injection system having one or more fuel injectors and an electronic control system therefore. The preferred fuel injector has a double magnetic latching solenoid three-way or four-way spool valve that controls the flow of a working fluid that is used to control the discharge of fuel into the combustion chamber or intake manifold of an engine through the nozzle of the injector. The control system provides actuating current pulses to each of the solenoids to actuate and latch the solenoids to effect initiation and termination of the injection. Disclosed are control systems that provide a snap action in one or both actuating directions of the valve by electromagnetically retaining the valve in the latched condition until the force in the actuated solenoid builds to a high level, and then releasing the valve for higher acceleration to the actuated position. Also disclosed is an exemplary control system that senses the arrival of valve at the actuated position so that the actuating current pulse can be terminated as soon as possible so as to allow a strong current pulse drive, but of low total energy, for fast actuation of a relatively small valve. Other embodiments, features and uses of the invention are disclosed.

BRIEF DESCRIPTION OF THE DRAWINGS

The objects and advantages of the present invention will become more readily apparent to those ordinarily skilled in the art after reviewing, the following detailed description and accompanying drawings, wherein:

FIG. 9 illustrates the connection of the circuit of FIG 8 to the coils 202 and 200 of the two solenoids 138 and 140 of FIG. 4.

FIG. 10 illustrates a typical control signal waveform.

FIG. 11 illustrates a typical current pulse in a solenoid coil of the present invention as driven by the circuit if FIG. 8.

FIG. 13 illustrates the connection of the circuit of FIG. 12 to the coils 202 and 200 of the two solenoids 138, and 140 of FIG. 4.

FIG. 19 is a block diagram of a circuit connected to the battery supply line for the injection system so that when the battery voltage as supplied to the injection system falls below some predetermined limit, the circuit will enable the operation of a step-up switching regulator which in turn provides a stepped up and regulated output voltage VOUT to a valve supply switching circuit.

FIG 20 is a circuit diagram for the block diagram of FIG. 19.

DETAILED DESCRIPTION OF THE INVENTION

Figure 4:
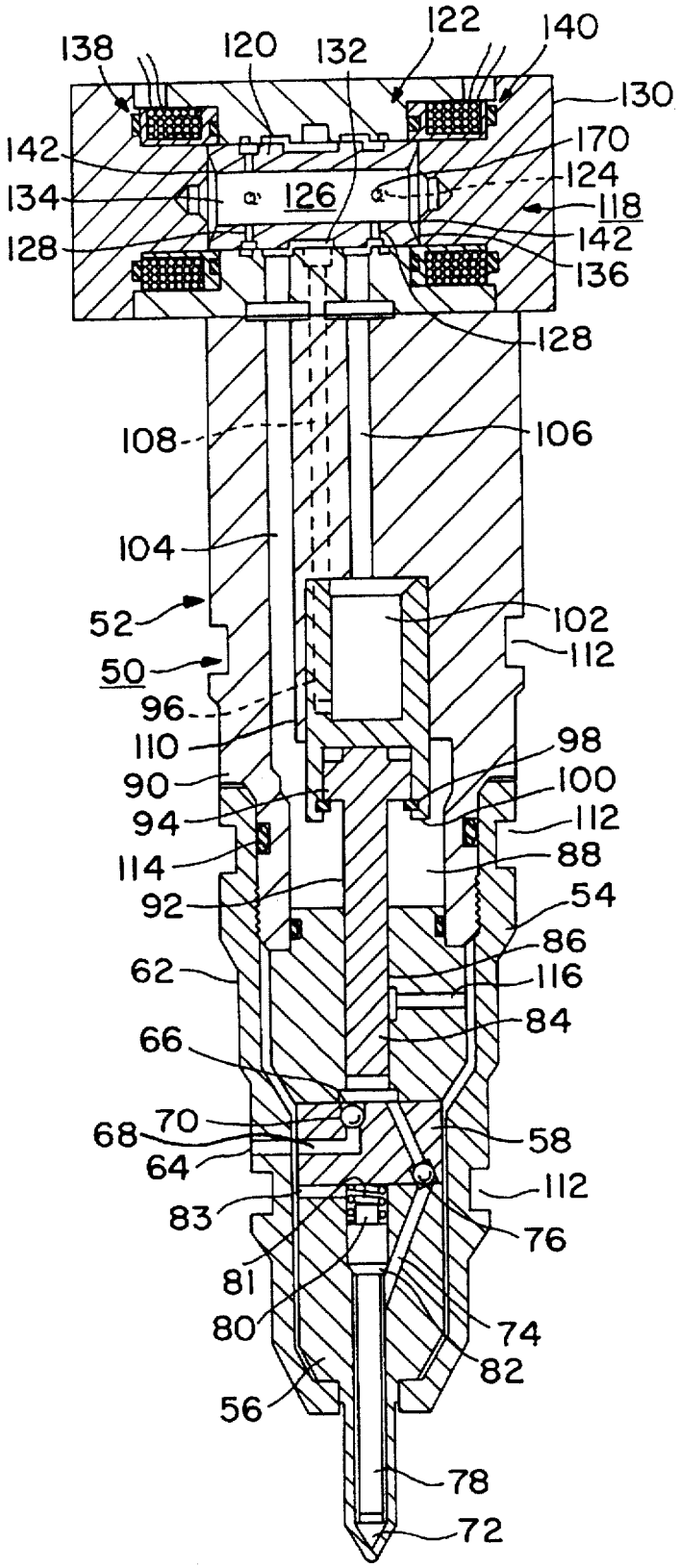
FIG. 4 is a cross-sectional view of a fuel injector with a four-way control valve that has a spool valve in a first position.
Figure 5:
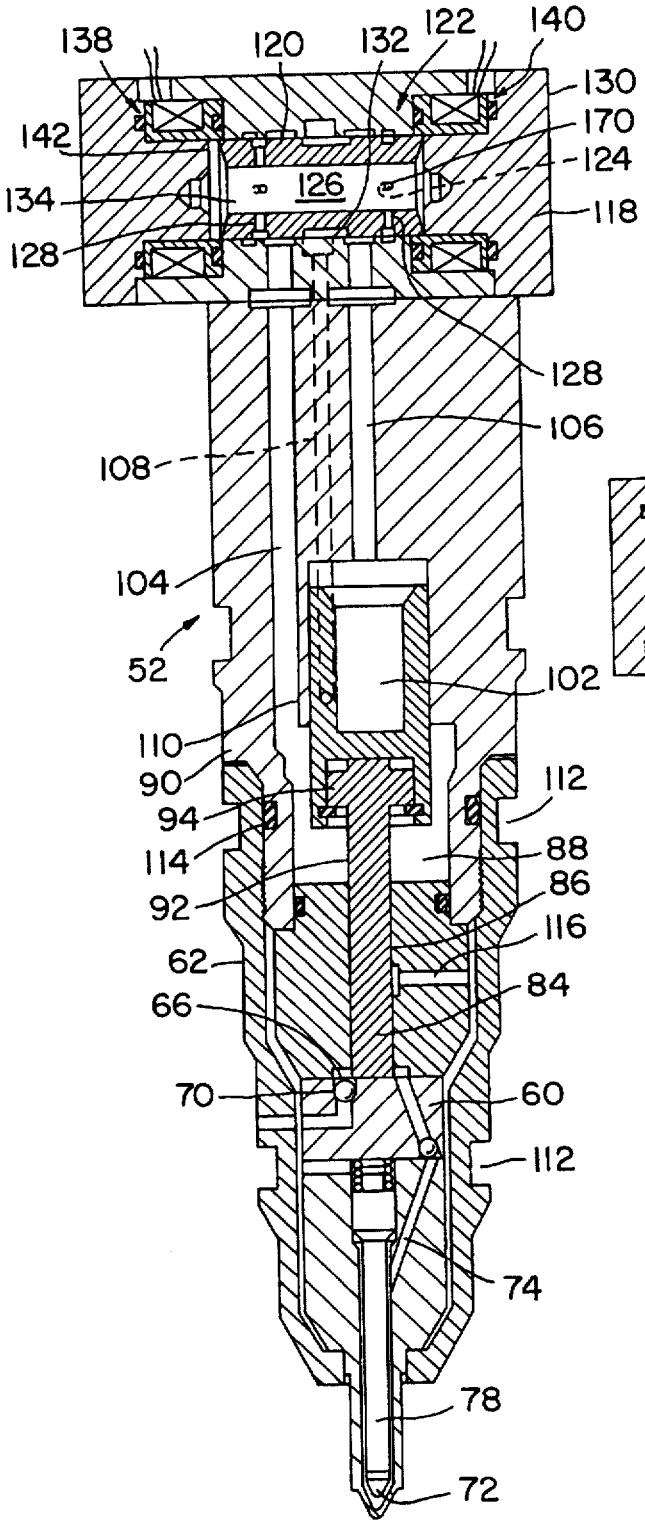
FIG. 5 is a cross-sectional view of the fuel injector with the spool valve in a second position.

Referring to the drawings more particularly by reference numbers, FIGS. 4 and 5 show a fuel injector 50 of the present invention. The fuel injector 50 is typically mounted to an engine block and injects a controlled pressurized volume of fuel into a combustion chamber (not shown). The injector 50 of the present invention is typically used to inject diesel fuel into a compression ignition engine, although it is to be understood that the injector could also be used in a spark ignition engine or any other system that requires the injection of a fluid.

The fuel injector 10 has an injector housing 52 that is typically constructed from a plurality of individual parts. The housing 52 includes an outer casing 54 that contains block members 56, 58, and 60. The outer casing 54 has a fuel port 64 that is coupled to a fuel pressure chamber 66 by a fuel passage 68. A first check valve 70 is located within fuel passage 68 to prevent a reverse flow of fuel from the pressure chamber 66 to the fuel port 64. The pressure chamber 66 is coupled to a nozzle 72 through fuel passage 74. A second check valve 76 is located within the fuel passage 74 to prevent a reverse flow of fuel from the nozzle 72 to the pressure chamber 66.

The flow of fuel through the nozzle 72 is controlled by a needle valve 78 that is biased into a closed position by spring 80 located within a spring chamber 81. The needle valve 78 has a shoulder 82 above the location where the passage 74 enters the nozzle 78. When fuel flows into the passage 74 the pressure of the fuel applies a force on the shoulder 82. The shoulder force lifts the needle valve 78 away from the nozzle openings 72 and allows fuel to be discharged from the injector 50.

A passage 83 may be provided between the spring chamber 81 and the fuel passage 68 to drain any fuel that leaks into the chamber 81. The drain passage 83 prevents the build up of a hydrostatic pressure within the chamber 81 which could create a counteractive force on the needle valve 78 and degrade the performance of the injector 10.

The volume of the pressure chamber 66 is varied by an intensifier piston 84. The intensifier piston 84 extends through a bore 86 of block 60 and into a first intensifier chamber 88 located within an upper valve block 90. The piston 84 includes a shaft member 92 which has a shoulder 94 that is attached to a head member 96. The shoulder 94 is retained in position by clamp 98 that fits within a corresponding groove 100 in the head member 96. The head member 96 has a cavity which defines a second intensifier chamber 102.

The first intensifier chamber 88 is in fluid communication with a first intensifier passage 104 that extends through block 90. Likewise, the second intensifier chamber 102 is in fluid communication with a second intensifier passage 106.

The block 90 also has a supply working passage 108 that is in fluid communication with a supply working port 110. The supply port is typically coupled to a system that supplies a working fluid which is used to control the movement of the intensifier piston 84. The working fluid is typically a hydraulic fluid that circulates in a closed system separate from the fuel. Alternatively the fuel could also be used as the working fluid. Both the outer body 54 and block 90 have a number of outer grooves 112 which typically retain 0-rings (not shown) that seal the injector 10 against the engine block. Additionally, block 62 and outer shell 54 may be sealed to block 90 by 0-ring 114.

Block 60 has a passage 116 that is in fluid communication with the fuel port 64. The passage 116 allows any fuel that leaks from the pressure chamber 66 between the block 62 and piston 84 to be drained back into the fuel port 64. The passage 116 prevents fuel from leaking into the first intensifier chamber 88.

The flow of working fluid into the intensifier chambers 88 and 102 can be controlled by a four-way solenoid control valve 118. The control valve 118 has a spool 120 that moves within a valve housing 122. The valve housing 122 has openings connected to the passages 104, 106 and 108 and a drain port 124. The spool 120 has an inner chamber 126 and a pair of spool ports that can be coupled to the drain ports 124. The spool 120 also has an outer groove 132. The ends of the spool 120 have openings 134 which provide fluid communication between the inner chamber 126 and the valve chamber 134 of the housing 122. The openings 134 maintain the hydrostatic balance of the spool 120.

The valve spool 120 is moved between the first position shown in FIG. 4 and a second position shown in FIG. 5, by a first solenoid 138 and a second solenoid 140. The solenoids 138 and 140 are typically coupled to a controller which controls the operation of the injector. When the first solenoid 138 is energized, the spool 120 is pulled to the first position, wherein the first groove 132 allows the working fluid to flow from the supply working passage 108 into the first intensifier chamber 88, and the fluid flows from the second intensifier chamber 102 into the inner chamber 126 and out the drain port 124. When the second solenoid 140 is energized the spool 120 is pulled to the second position, wherein the first groove 132 provides fluid communication between the supply working passage 108 and the second intensifier chamber 102, and between the first intensifier chamber 88 and the drain port 124.

The groove 132 and passages 128 are preferably constructed so that the initial port is closed before the final port is opened. For example, when the spool 120 moves from the first position to the second position, the portion of the spool adjacent to the groove 132 initially blocks the first passage 104 before the passage 128 provides fluid communication between the first passage 104 and the drain port 124. Delaying the exposure of the ports, reduces the pressure surges in the system and provides an injector which has more predictable firing points on the fuel injection curve.

The spool 120 typically engages a pair of bearing surfaces 142 in the valve housing 122. Both the spool 120 and the housing 122 are preferably constructed from a magnetic material such as a hardened 52100 or 440*c* steel, so that the hysteresis of the material will maintain the spool 120 in either the first or second position. The hysteresis allows the solenoids to be de-energized after the spool 120 is pulled into position. In this respect the control valve operates in a digital manner, wherein the spool 120 is moved by a defined pulse that is provided to the appropriate solenoid. Operating the valve in a digital manner reduces the heat generated by the coils and increases the reliability and life of the injector.

In operation, the first solenoid 138 is energized and pulls the spool 120 to the first position, so that the working fluid flows from the supply port 110 into the first intensifier chamber 88 and from the second intensifier chamber 102 into the drain port 124. The flow of working fluid into the intensifier chamber 88 moves the piston 84 and increases the volume of chamber 66. The increase in the chamber 66 volume decreases the chamber pressure and draws fuel into the chamber 66 from the fuel port 64. Power to the first solenoid 138 is terminated when the spool 120 reaches the first position.

When the chamber 66 is filled with fuel, the second solenoid 140 is energized to pull the spool 120 into the second position. Power to the second solenoid 140 is terminated when the spool reaches the second position. The movement of the spool 120 allows working fluid to flow into the second intensifier chamber 102 from the supply port 110 and from the first intensifier chamber 88 into the drain port 124.

The head 96 of the intensifier piston 96 has an area much larger than the end of the piston 84, so that the pressure of the working fluid generates a force that pushes the intensifier piston 84 and reduces the volume of the pressure chamber 66. The stroking cycle of the intensifier piston 84 increases the pressure of the fuel within the pressure chamber 66. The pressurized fuel is discharged from the injector through the nozzle 72. The fuel is typically introduced to the injector at a pressure between 1000–2000 psi. In the preferred embodiment, the piston has a head to end ratio of approximately 10:1, wherein the pressure of the fuel discharged by the injector is between 10,000–20,000 psi.

Figure 1:
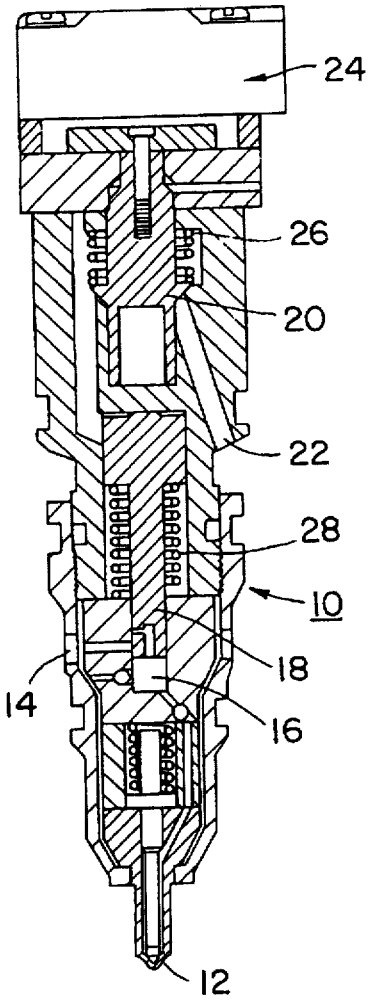
FIG. 1 PRIOR ART
FIG. 1 is a cross-sectional view of a fuel injector of the prior art.
Figure 2:
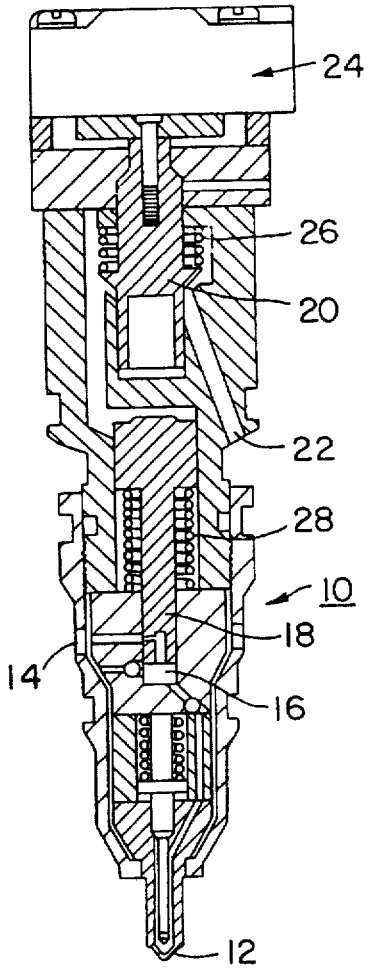
FIG. 2 PRIOR ART
FIG. 2 is a cross-sectional view similar to FIG. 1, showing the fuel injector injecting fuel.
Figure 3:
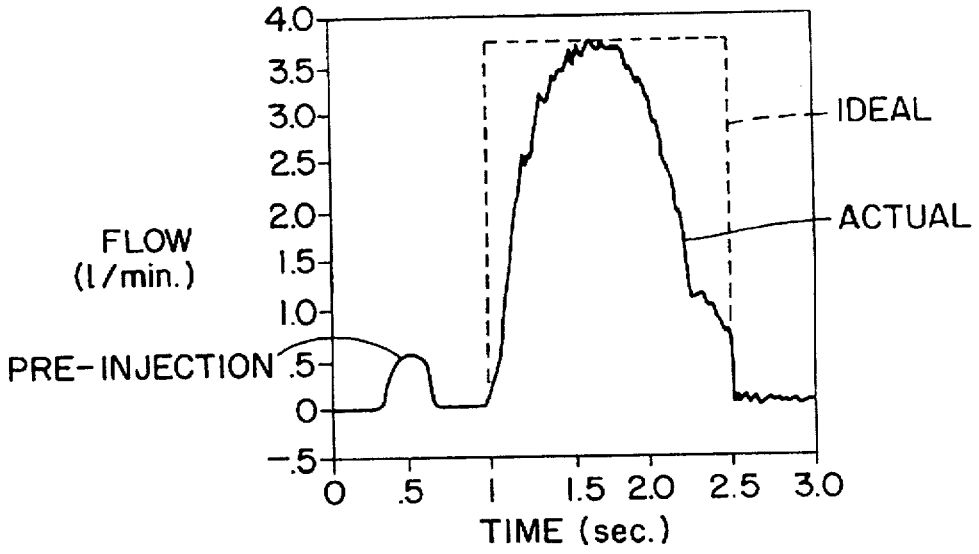
FIG. 3 is a graph showing the ideal and actual fuel injection curves for a fuel injector.

After the fuel is discharged from the injector the first solenoid 138 is again energized to pull the spool 120 to the first position and the cycle is repeated. It has been found that the double solenoid spool valve of the present invention provide a fuel injector which can more precisely discharge fuel into the combustion chamber of the engine than injectors of the prior art. The increase in accuracy provides a fuel injector that more closely approximates the square fuel curve shown in the graph of FIG. 3. The high speed solenoid control valves can also accurately supply the pre-discharge of fuel shown in the graph.

Figure 6:
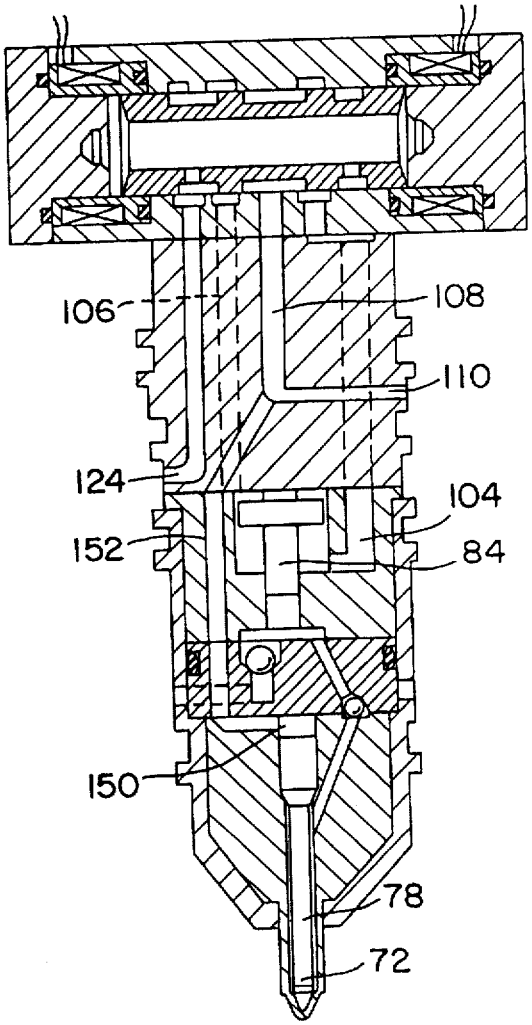
FIG. 6 is an alternate embodiment of the fuel injector of FIG. 4.

FIG. 6 shows an alternate embodiment of a fuel injector of the present invention which does not have a return spring for the needle valve. In this embodiment the supply working passage 108 is coupled to a nozzle return chamber 150 by passage 152. The needle valve 78 is biased into the closed position by the pressure of the working fluid in the return chamber 150. When the intensifier piston 84 is stroked, the pressure of the fuel is much greater than the pressure of the working fluid, so that the fuel pressure pushes the needle valve 78 away from the nozzle openings 72. When the intensifier piston 84 returns to the original position, the pressure of the working fluid within the return chamber 150 moves the needle valve 78 and closes the nozzle 72.

Figure 7:
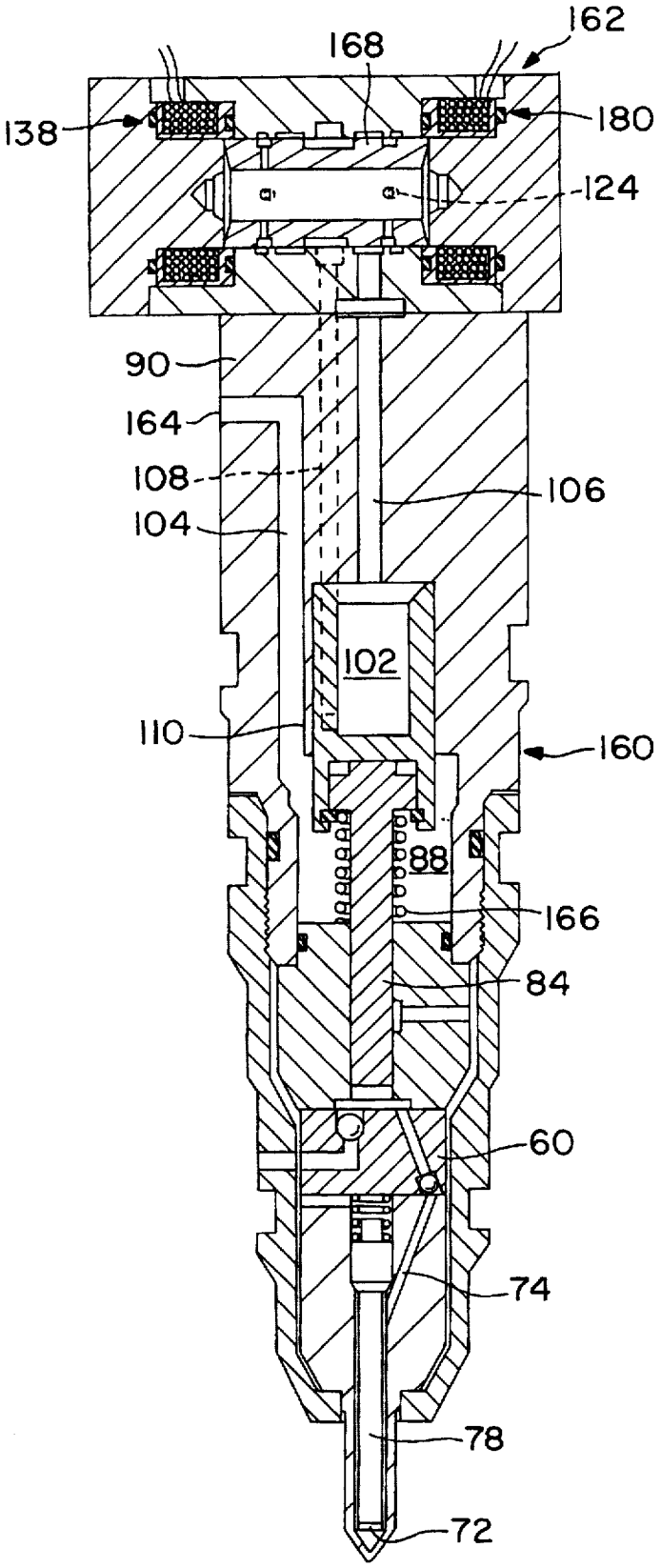
FIG. 7 is a cross-sectional view of an alternate embodiment of a fuel injector which has a three-way control valve.

FIG. 7 shows an injector 160 controlled by a three-way control valve 162. In this embodiment, the first passage 108 is connected to a drain port 164 in block 90, and the intensifier piston 84 has a return spring 166 which biases the piston 84 away from the needle valve 78. Movement of the spool 168 provides fluid communication between the second passage 106 and either the supply port 110 or the drain port 124.

When the spool 168 is in the second position, the second passage 106 is in fluid communication with the supply passage 108, wherein the pressure within the second intensifier chamber 102 pushes the intensifier piston 84 and pressurized fuel is ejected from the injector 160. The fluid within the first intensifier chamber 88 flows through the drain port 164 and the spring 166 is deflected to a compressed state. When the spool 168 is pulled by the first solenoid 138 back to the first position, the second passage 106 is in fluid communication with the drain port 124 and the second intensifier chamber 102 no longer receives pressurized working fluid from the supply port 110. The force of the spring 166 moves the intensifier piston 84 back to the original position. The fluid within the second intensifier chamber 102 flows through the drain port 124.

Both the three-way and four-way control valves have inner chambers 126 that are in fluid communication with the valve chamber 132 through spool openings 134, and the drain ports 124 through ports 130. The ports inner chamber and openings insure that any fluid pressure within the valve chamber is applied equally to both ends of the spool. The equal fluid pressure balances the spool so that the solenoids do not have to overcome the fluid pressure within the valve chamber when moving between positions. Hydrostatic pressure will counteract the pull of the solenoids, thereby requiring more current for the solenoids to switch the valve. The solenoids of the present control valve thus have lower power requirements and generate less heat than injectors of the prior art, which must supply additional power to overcome any hydrostatic pressure within the valve. The balanced spool also provides a control valve that has a faster response time, thereby increasing the duration interval of the maximum amount of fuel emitted by the injector. Increasing the maximum fuel duration time provides a fuel injection curve that is more square and more approximates an ideal curve.

As shown in FIG. 4, the ends of the spool 120 may have concave surfaces 170 that extend from an outer rim to openings 134 in the spool 120. The concave surfaces 170 function as a reservoir that collects any working fluid that leaks into the gaps between the valve housing 122 and the end of the spool. The concave surfaces significantly reduce any hydrostatic pressure that may build up at the ends of the spool 120. The annular rim at the ends of the spool 120 should have an area sufficient to provide enough hysteresis between the spool and housing to maintain the spool in position after the solenoid has been de-energized.

Figure 8:
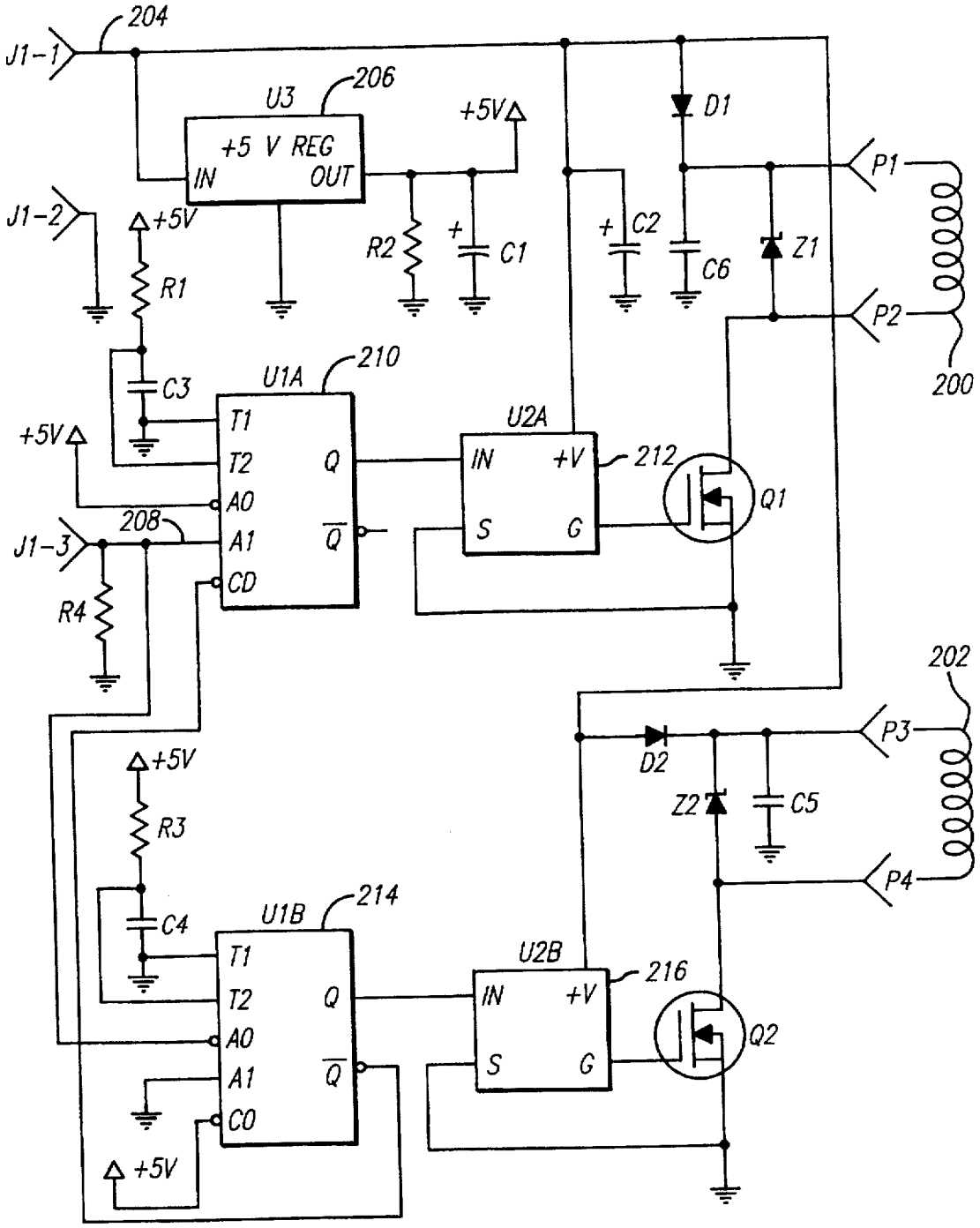
FIG. 8 is a circuit diagram for a basic valve controller in accordance with the present invention.
Figure 12A:
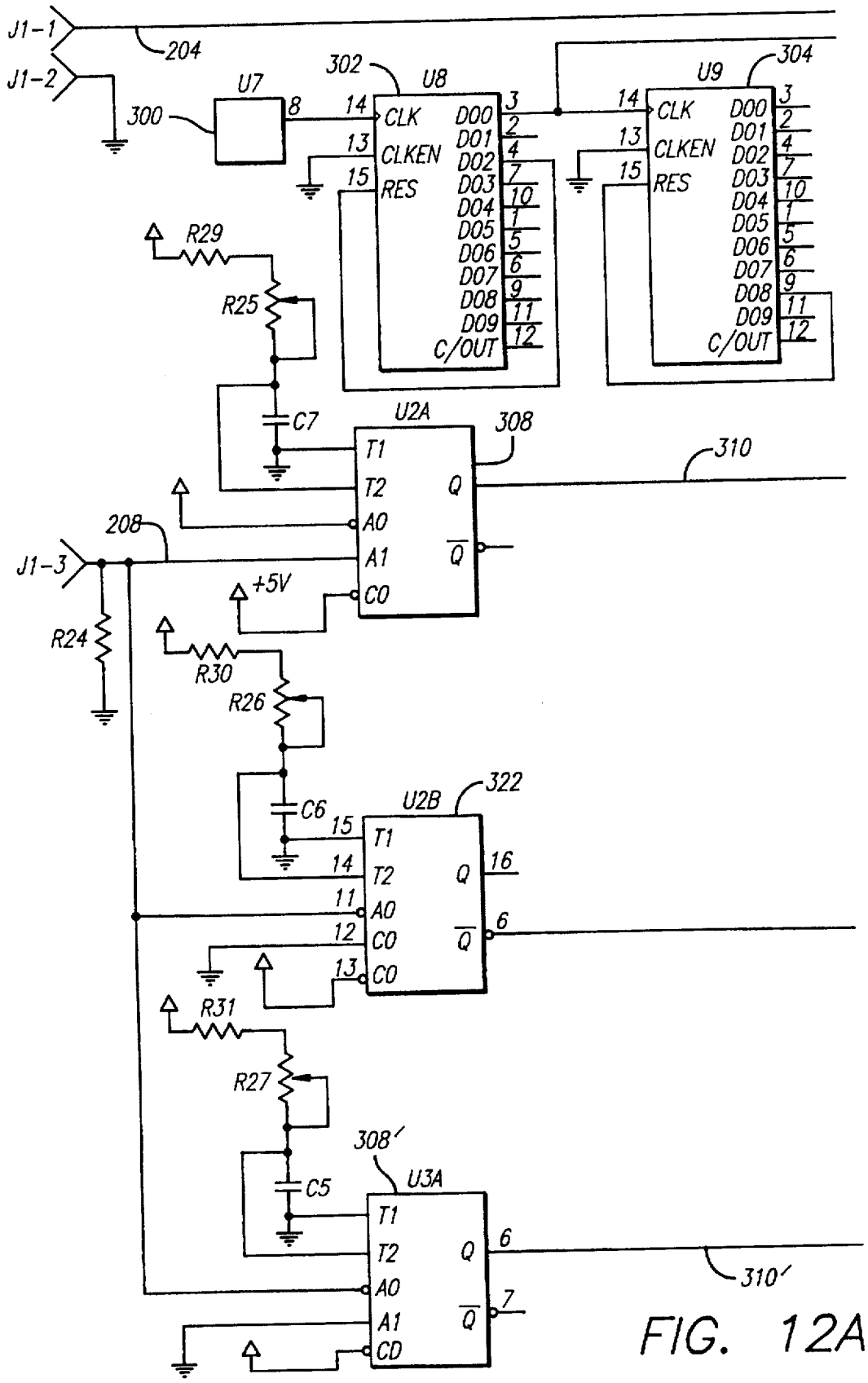
FIGS 12A–C show a circuit diagram for another controller circuit of the present invention.
Figure 12B:
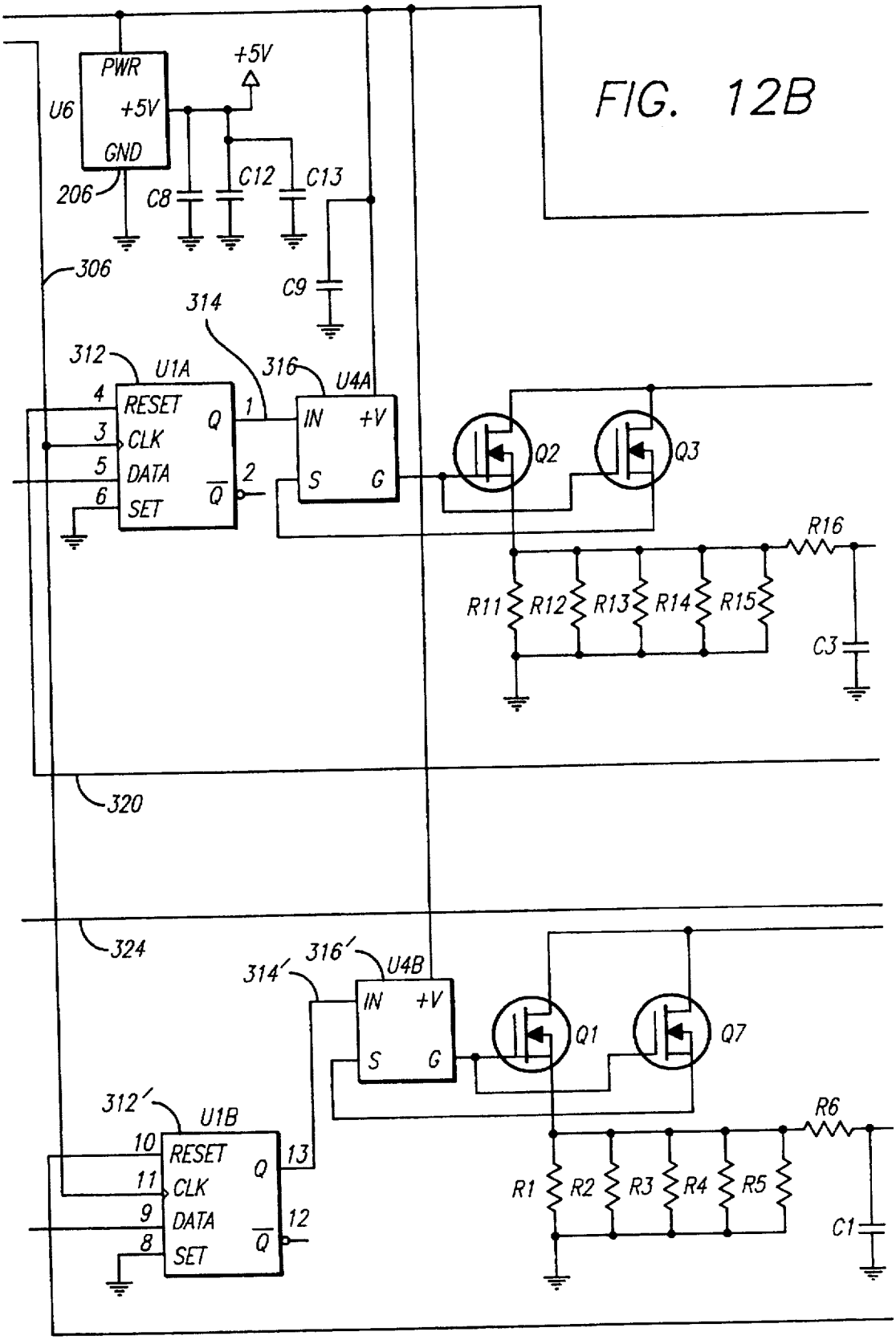
Figure 12C:
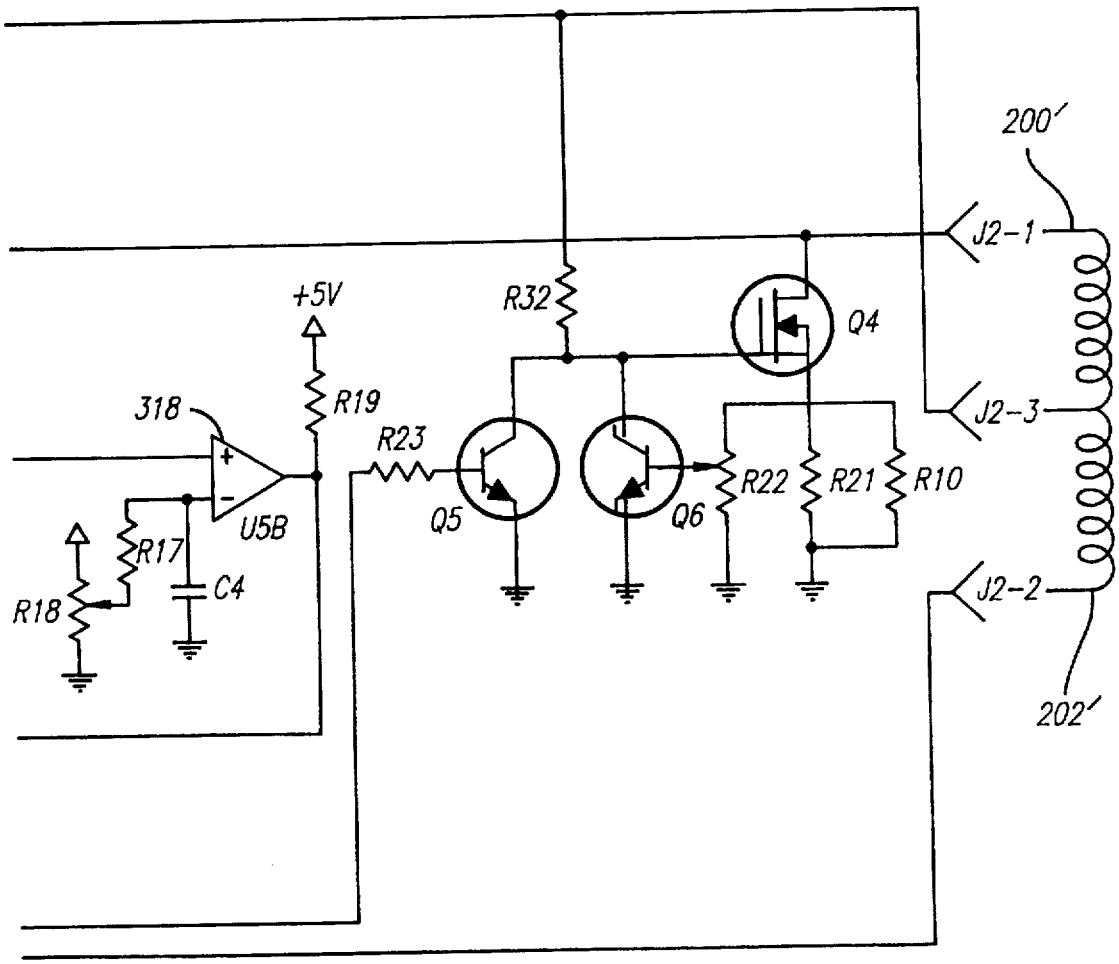
Figure 12C:
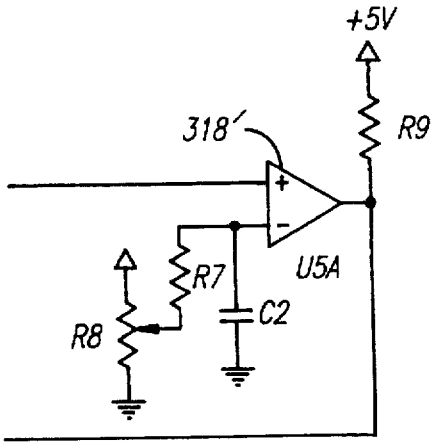

Now referring to FIG. 8, a basic valve controller in accordance with the present invention may be seen. This controller circuit is relatively small, and as shall subsequently be seen, results in lower system power consumption, and accordingly can be mounted directly on the injector assembly itself. The circuit is intended to be used with solenoids of the hereinbefore described fuel injector by connection to the coils 202 and 200 of the two solenoids 138 and 140. As shown in FIG. 9, coil 200 has its leads connected to connections P1 and P2 of FIG. 8 and coil 202 has its leads connected to connections P3 and P4 of FIG. 8. In addition, the circuit of FIG. 8 is connected to a power source and source of control signal through a connector J1, with connection J1-1 being connected to the vehicle or engine battery, typically 12 or 24 volts in the case of large diesel engines. Connection J1-2 is connected to the battery ground, and connection J1-3 is connected to a control source for providing a control signal to the driver circuit.

The battery voltage on line 204 is provided to a five-volt regulator 206 which provides a five-volt supply voltage for various devices in the circuit. Capacitor C1 is a smoothing capacitor for the five-volt output, with resistor R2 providing a trickle load on the regulator to prevent the five-volt output from drifting upward in the relative absence of other loads. The voltage on line 204 is also provided through diode D1 to solenoid coil connection P1 and through diode D2 to solenoid coil connection P3. Capacitor C2, a relatively large capacitor, provides a smoothing effect on the battery voltage on line 204, thereby providing some protection against transients when the solenoid coils are switched in and out of circuit. Capacitor C5 and C6 provide a similar smoothing when the respective solenoid coil is switched in circuit.

The remainder of the circuit of FIG. 8 is perhaps best described by following the signal flow for a typical control signal applied to the control line J1-3. When the injector is in the quiescent state, the voltage on the control line 208 will be at the low state, either held low by the microcomputer or other digital circuit driving the same, or pulled low by the pull-down resistor R4. This holds the Q output of the monostable multivibrator 210 low, which in turn holds the output of the voltage translator 212 low, holding n-channel power device Q1 off. At the same time, the Q output of a similar monostable multivibrator 214 will also be low, having previously returned to the low state of its prior monostable cycle. This holds the input to the translation device 216 low, the output of which holds the gate of power n-channel device Q2 low, holding the device off. Thus, in this state, both power devices Q1 and Q2 are off, so that one lead of each solenoid coil is one diode voltage drop below the battery voltage on line 204, with the opposite coil connection of each coil essentially floating and thus being at the same voltage as the first connection.

A typical signal format on line 208 is shown in FIG. 10. On the positive going side of the pulse, the monostable multivibrator 210 is triggered, driving the Q output high which in turns drives the output of the voltage translator 212 high, turning on the power n-channel device Q1. This essentially grounds connection P2, so that now the full battery voltage is connected across solenoid coil 200 (less one diode voltage drop of diode D1 and the on voltage drop across power device Q1) pulling the spool towards solenoid 140 (see FIG. 4) to pressurize the intensifier chamber 102 and initiate fuel injection. At the same time, the RC combination of resistor R1 and capacitor C3 determines the length of time the monostable multivibrator 210 remains in the triggered state until returning to the quiescent state with the Q output thereof low, thereby turning n-channel power device Q1 off again to terminate current flow in coil 200. In general, the pulse of the monostable multivibrator 210 is chosen to be equal to the actuating time, that is the transit time for the spool from one stable position to the opposite stable position, plus a time increment as a margin of safety to accommodate adverse extremes in battery voltage, solenoid coil resistance, temperature, etc., and further to accommodate bounce of the spool when it reaches its new position. At the end of the period of the monostable multivibrator 210 operation, the power n-channel device Q1 is turned off, terminating the temporary connection of solenoid lead P2 to ground. The resulting back EMF of the solenoid coil forward biases zener diode Z1, with the current in the coil rapidly diminishing to zero as the result of the energy dissipation in the voltage drop of the diode and the resistance of the coil.

Thus, the resulting current pulse in solenoid coil 200 will be approximately as shown in FIG. 11. The current pulse lasts just long enough to assure that the spool travels to the opposite extreme of its travel and latches at that position to initiate injection, plus of course some time margin of comfort, after which the pulse is terminated. Similarly, at the end of the control pulse of FIG. 10, the monostable multivibrator 214 is triggered, pulsing power n-channel device Q2 on through voltage translator 216, thereby returning the spool to its initial position to terminate the injection of the fuel injector. As before, the monostable multivibrator 214 will itself time out after a safe operating time for the spool as determined by resistor R3 and capacitor C4, thereby turning off power n-channel device Q2, with the resulting current pulse in coil 202 decaying rapidly through the forward biased zener Z2 during the decay period due to the back EMF of coil 202.

From the foregoing description, it may be seen that a simple pulse control signal having a time period equal to the desired injection time period may be provided to the circuit of FIG. 8, with the simple control waveform being converted to a first latching current pulse to initiate injection at the beginning of the injection control signal and a second current pulse to assure latching to terminate injection at the end of the injection control pulse. This is to be compared with prior art solenoid actuated injectors wherein power must be applied to the injector solenoid throughout the duration of the injection control pulse. Because of this continuous application of power during injection, the prior art required solenoid operated valves of a size and power dissipation capability adequate to absorb the full solenoid actuating current for the longest injection time (or injection duty cycle) required of the injector. The net result is that the solenoid valve of the prior art is generally required to be much larger than with the present invention, which in turn tends to slow the valve operation, resulting in a slow injection rise time and, what is particularly bad, a slow injection termination. In that regard, note that full travel of the spool of the valve of the present invention injectors will be achieved at approximately 218 (FIG. 11) while the current in the respective solenoid is still rising, though power to the solenoid coil is itself terminated shortly thereafter, again while the current is still rising. If, on the other hand, the current was not terminated before the end of the pulse of FIG. 10, the current would continue to rise, even in the present invention, to considerably higher levels, resulting in a much higher current for a much longer period, increasing the power dissipation to excessive levels, perhaps on the order of one to two orders of magnitude. To avoid this problem, either expensive, relatively large and power consuming current limiting circuitry would be required, or alternatively the drive on the solenoid would need to be reduced so that the average power consumption was tolerable, thereby very substantially reducing the speed of operation of the solenoid valve and thus of the injector. Accordingly, the valve controller circuit of FIG. 8 is a highly efficient circuit for controlling valves such as fuel injection valves, allowing high drive, very fast solenoid operating current pulses while maintaining a low total power consumption, allowing the use of small solenoids and avoiding substantial temperature rise thereof above the already quite warm environment of an operating engine.

Now referring to FIG. 12, another controller circuit illustrating another aspect of the present invention may be seen. Like the circuit of FIG. 8, this circuit operates from a low impedance battery power supply with the battery voltage applied between connector pins J1-1 and J1-2 of connector J1, and operates from a control signal on connector pin J1-3 of connector J1, the control signal being in the same form as illustrated in FIG. 10 with respect to the circuit of FIG. 8. The solenoid coil connections, however, are slightly different from those shown in FIG. 9, namely the two solenoid coils 200' and 202' are connected in series as shown in FIG. 13, with the common connection J2-3 being coupled to the battery supply voltage on line 204.

In the circuit FIG. 8, as previously described, power is applied to one of the two solenoids for a period of time adequate to assure that the spool has been attracted to the respective solenoid so that when the current pulse is removed, the retentivity of the spool and the stationary parts of the respective solenoid will provide a sufficient residual field strength to latch the spool at that position. Thus, when the solenoid coil for the opposite solenoid is energized, the spool will remain latched in the previously energized position until the force of the newly energized solenoid overcomes the force of the residual magnetism of the latched solenoid, at which time spool motion will commence. As soon as any gap is created between the spool and the end of the solenoid from which it is moving away, the residual field due to the retentivity will essentially collapse, allowing the spool to be rapidly accelerated by the now already substantial force of the solenoid being actuated. The net result is that not only is the power consumption low for the system of FIG. 8, but also valve operation is very fast. However, the exact timing of the beginning of spool motion, the force of the actuated solenoid at the time motion begins, etc., will vary somewhat dependent upon the amount of retentivity in the spool and the stationary magnetic parts of the solenoid, whether there was any bounce after the prior actuating current pulse diminished, just how well the parts mate, etc. Consequently, there can be some small spool valve and thus injector timing variation unit to unit and for a given unit, particularly over the operating temperature range of the unit and the operating fluid of the unit (fuel or hydraulic fluid). The embodiment of FIG. 12, on the other hand provides both a more controlled release of the latched solenoid shortly after excitation of the opposite solenoid, achieving both more precise time of initiation of spool motion and a faster rising unbalanced magnetic force to decrease the transit time of the spool in the spool valve to increase the speed of injector valve operation. This is achieved by a sort of snap action, wherein a current, typically limited in magnitude, is provided to the coil of the latched solenoid, typically simultaneously with the application of the actuating current pulse to the coil of the other solenoid. This purposely and controllably holds the latched solenoid until the field strength in the other solenoid rises to a relatively high level, when the current in the latched solenoid is then terminated. Now the initiation of motion is more precise in time (crank shaft angle, etc.) and the acceleration of the spool to the opposite latched position is greater, providing faster injector operation, The specific circuit shown in FIG. 12 provides the foregoing described snap action only in one direction of operation of the spool valve, specifically the turning off of the injector valve in a typical fuel injection system, such as direct combustion chamber injection in a diesel engine, as a sharp cutoff is particularly advisable to minimize the amount of unburned or partially burned fuel in the engine exhaust.

Referring specifically to FIG. 12, as before, a five volt regulator 206 is connected to the battery voltage on line 204 to provide a five volt output for operation of various other circuits of the Figure. Capacitors C8, C12 and C13 provide noise suppression on the five volt line. The specific circuit shown is a clocked circuit (though a corresponding free-running circuit may also be used). Thus, an oscillator 300 provides a clock signal to counter-divider 302 which in turn provides a clock signal to counter-divider 304, with an appropriate clock signal on line 306 being taken from an output of either counter-divider as may be suitable for the specific application. In general, the clock signal on line 306 should be sufficiently high so that the time period of one clock cycle is of no particular significance to the overall timing requirements of the system.

As before, when the signal on line 208 goes high (see FIG. 10), monostable multivibrator 308 is triggered so that its Q output on line 310 forming the data input to D flip-flop 312 goes high. Thus, on the next clock cycle, the Q output of the D flip-flop 312 on line 314 triggers a voltage translator 316 to turn on power n-channel devices Q2 and Q3, which devices are connected in parallel and have their sources connected to ground through a parallel combination of low valued resistors R11 through R15. This pulls the voltage on connector terminal J2-1 low, applying power to solenoid coil 200' (FIG. 13) to pull the valve spool to solenoid 140 and latch the same at that position.

As with the circuit in FIG. 8, the monostable multivibrator 308 will time out after a time period determined by the combination of capacitor C7, fixed resistor R29 and variable resistor R25, which time out could be used as before to drive the Q output on line 310 low to turn off the power n-channel devices Q2 and Q3 to terminate the current pulse. Instead, however, in this embodiment, the voltage across the parallel combination of resistors R11 through R15 is coupled through resistor R16 to the positive input of comparator 318, the negative input of which is determined by the setting of variable resistor R18. Resistor R16 and capacitor C3 provide high frequency noise suppression to the positive input of the comparator 318, with resistor R17 and capacitor C4 providing similar high frequency noise suppression to the negative input of the comparator. The specific comparator used (LM339) has a grounded emitter, floating collector NPN transistor output, with resistor R19 pulling the output of the comparator high whenever the positive input to the comparator exceeds the negative input. Thus, as the current in solenoid coil 200' rises (much like the current in coil 200 is shown to rise in FIG. 11). The voltage across the parallel combination in resistors R11 through R15 rises, triggering the comparator at a level determined by the setting of variable resistance R18 so as to allow the pull-up resister R19 to pull the voltage on line 320 high to reset the D flip-flop 312, driving the Q output thereof on line 314 low and thus the output of voltage translator 316 low to turn off devices Q2 and Q3 based not on a time-out, but rather upon the reaching of a predetermined desired current.

The termination of the actuation pulse based on reaching a predetermined desired solenoid actuation current as opposed to merely a predetermined time-out of the current pulse has substantial further advantages in terms of power consumption, particularly as it relates to the size of the solenoid coils and the amplitude of the current pulse which may be used without substantially heating the coils, and particularly without overheating the coils. In particular, the field strength pulling the spool away from the other solenoid against the force of the residual magnetism thereof is proportional to the current in the solenoid coil being actuated. The force, on the other hand, is proportional to the square of the current. Accordingly, while the battery voltage on line 204 may vary dependent upon the state of charge of the battery and other loads thereon, even momentary loads, and the resistance of the solenoid coils unit to unit and with temperature may vary quite significantly, the peak current attained is an excellent guarantee that the spool has pulled away from the opposite solenoid and completed its travel to the solenoid being powered. Thus, if the battery voltage is low by ten percent, and the solenoid resistance is high by ten percent, the rise time on the current pulse generally in the form shown in FIG. 11 will be slower, so that the current pulse will be longer in time before the predetermined desired current amplitude is reached and the current pulse is terminated. Thus, the circuit automatically adjusts for the more widely varying parameters to limit the current pulse amplitude only to that required to assure fast and reliable operation of the spool valve of the injector.

In comparison, without the current shut-off based on amplitude of the pulse, the current pulse width to actuate and latch a solenoid would have to be at least as long as required under the worst of conditions. Then in the case of a high battery voltage and low coil resistance, the current pulse may climb well above the predetermined necessary limit before terminating. Since the instantaneous power dissipation in the solenoid coil is proportional to the square of the current, considerable excess power will be dissipated in the solenoid coil under these conditions, providing substantial unnecessary heating of the solenoid coil. In that regard, the difference in spool valve heating between the controller of FIG. 8 and the controller of FIG. 12 when simulating fuel injection in an operating engine is substantial, the heating of the spool valve above ambient temperature being significant when operating under the controller of FIG. 8 and insubstantial when operated with the controller of FIG. 12, even when driven hard for high speed operation thereof.

For the actuation of the opposite solenoid for return of the spool valve to the original position using the controller of FIG. 12, the circuit comprising devices 308', 312', 316', Q1, Q7 and 318' operate in the same manner as the corresponding unprimed numbered components hereinbefore described, the monostable multivibrator 308' being triggered on the negative going side of the control signal on line 208 (see FIG. 10 for the control signal waveform). However, the release of the spool from its latched position is delayed until the field in the solenoid being actuated builds to a substantial level, at which time it is then released, thereby providing a sort of snap action for increased operating speed. In particular, in this circuit, when the monostable multivibrator 308' is triggered, the monostable multivibrator 322 is also triggered, driving the $\overline{Q}$ output on line 324 low, thereby turning off transistor Q6 through resistor R23. Since prior to the triggering of the monostable multivibrator 322, the $\overline{Q}$ output thereof on line 324 was high, thereby holding transistor Q6 on through resistor R23, the gate of the power n-channel device Q4 had been held low, thereby holding the device off. Similarly, the power n-channel devices Q2 and Q3 were also off, the actuating current pulse for coil 200' being terminated before this time. Consequently, when the monostable multivibrator 322 is triggered together with the monostable multivibrator 308', the voltage on line 324 going low turns off transistor Q6. Since at this instant the current through power n-channel device Q4 was zero, the base voltage on transistor Q5 is also zero, holding the same off. Consequently, pull-up resistor R32 is free to pull the gate of power n-channel device Q4 high, turning the same on.

In general, the value of fixed resistors R10 and R21 as well as variable resistor R22 are substantially higher than the corresponding parallel combination of resistors R1 through R5. Thus, although the current pulse in coil 202' is rapidly rising, a corresponding current pulse in coil 200' is rising at a lower rate. However, because the magnetic gap in the solenoid powered by coil 200' is substantially zero, whereas the magnetic gap in the solenoid powered by coil 202' is at a maximum, the magnetic field in the solenoid powered by the coil 200' may be caused to build from the residual field at as high or higher a rate than the field in the solenoid powered by the coil 202'. As a result, the spool will remain latched as the field and thus the force in the solenoid powered by coil 202' rises to quite a substantial level. Then when the lower current in coil 200' through power n-channel device Q4 reaches a predetermined level, albeit still considerably lower than the current in coil 202', the voltage drop across resistors R10, R21 and R22 will become adequate to start to turn on transistor Q5, pulling the gate voltage of power n-channel device Q4 lower so as to limit the current therethrough and thus through coil 200' to a level adequate to hold the base voltage of transistor Q5 at 1 VBE above ground. Thus the current in coil 200' becomes clamped at a moderate value, as even the moderate value provides a high latching force because of the zero magnetic gap in the respective solenoid magnetic circuit. Then, when monostable multivibrator 322 times out, the $\overline{Q}$ output thereon on line 24 will go high, turning on transistor Q6 to pull the gate voltage of power n-channel device Q4 low, turning the same off to quickly terminate the latching current in coil 200', allowing the now high force in the solenoid powered by coil 202' to very rapidly accelerate the valve spool to the opposite position. Shortly thereafter, of course, monostable multivibrator 308' will itself time out, after which the next clock cycle will turn off power n-channel devices Q1 and Q7 to terminate the current pulse in coil 202' after the spool has been latched in its new position.

It will be noted that the circuit of FIG. 12 does not include the back EMF suppression zener diodes Z1 and Z2 of the circuit of FIG. 8. Back EMF protection is provided, however, by the power n-channel devices themselves, the IRF540 devices effectively having back EMF zeners therein. In that regard, the zener diodes in the circuit of FIG. 8 are forward biased by the back EMF so that the current pulse tails decline slower than necessary, whereas the internal zener devices in the power n-channel devices of FIG. 12 only conduct in the reverse direction across the zener voltage, causing a more rapid declining current pulse tail. If desired, each zener diode of FIG. 8 might be replaced by two zeners in series and connected in opposite polarity to achieve a more rapid current pulse termination.

Figure 14A:
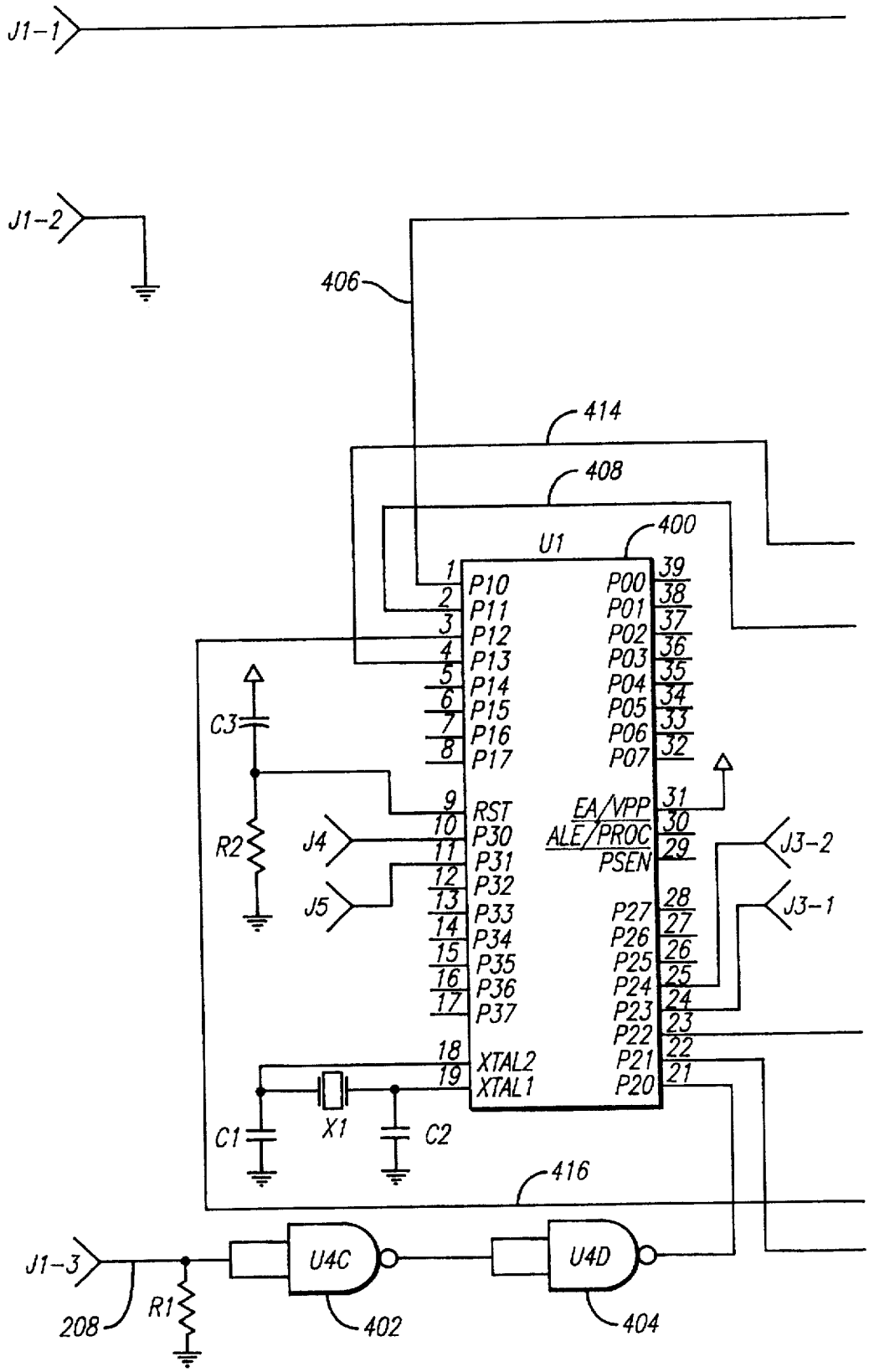
FIGS. 14A–C show is a circuit diagram for a still further control circuit in accordance with the present invention.
Figure 14B:
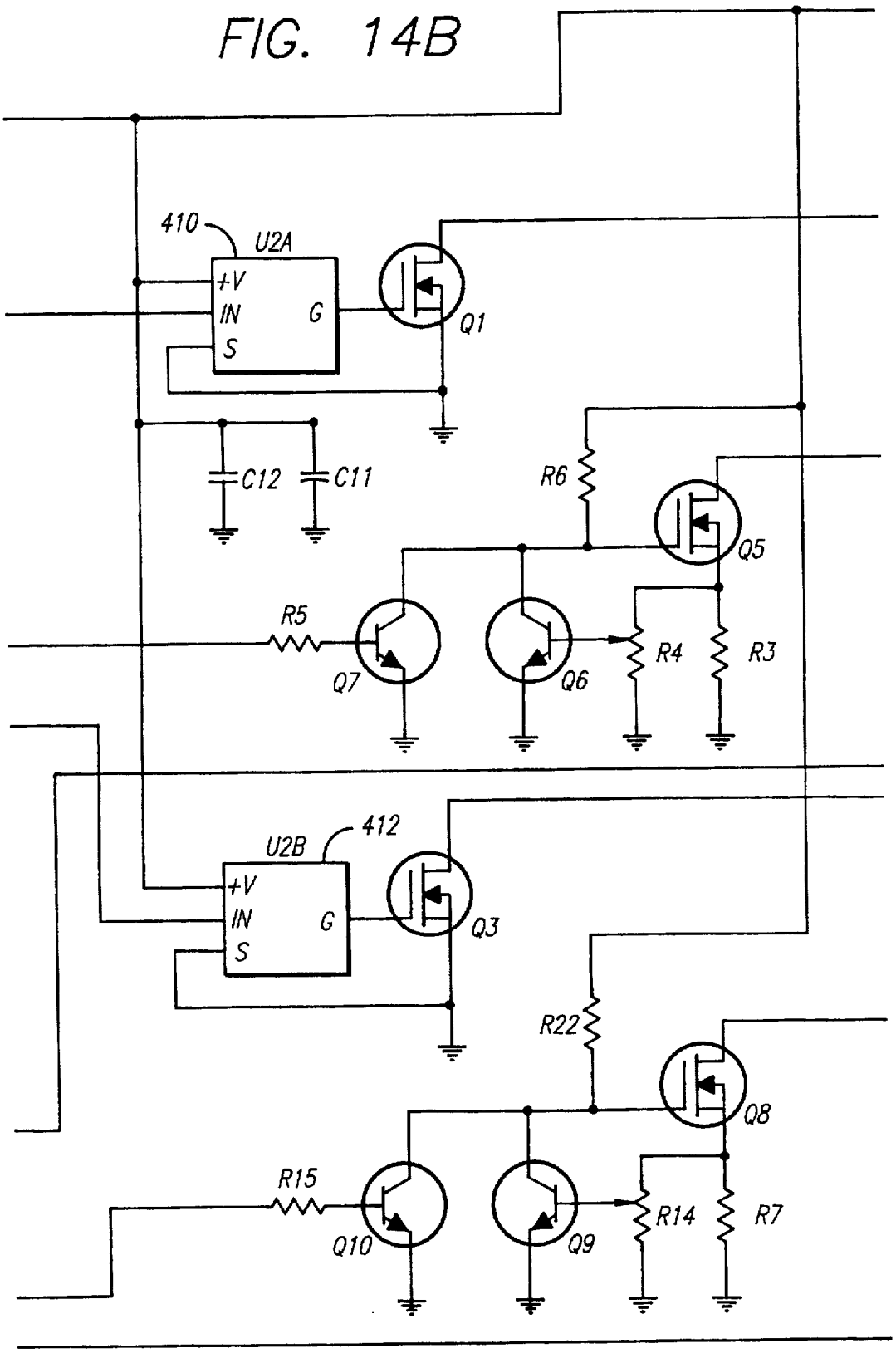
Figure 14C:
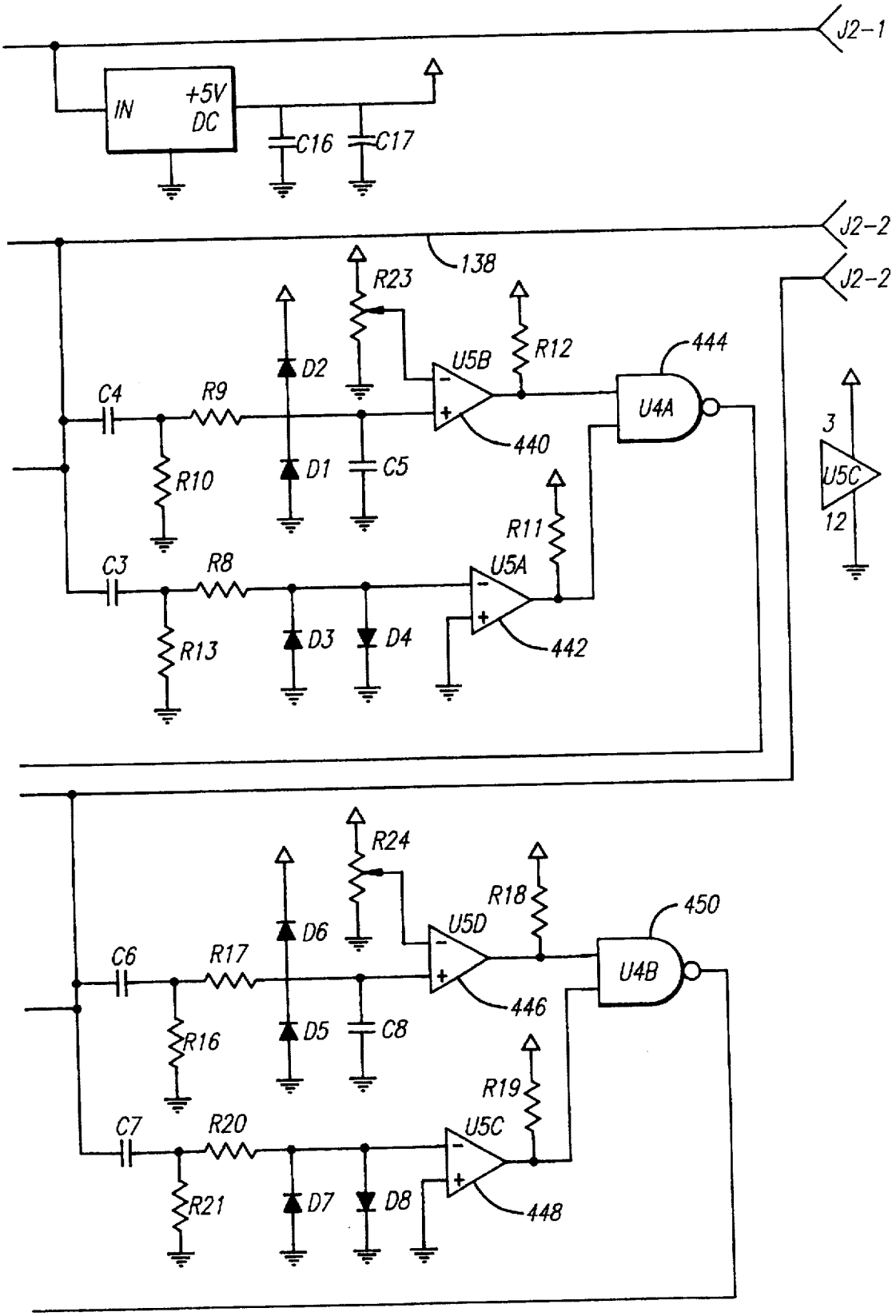

Now referring to FIG. 14, a still further embodiment of the present invention may be seen. This embodiment illustrates a still further aspect of the invention. In particular, in this embodiment, when one solenoid is actuated, the opposite solenoid is used to sense the position of the valve spool so that the actuating current pulse may be terminated upon arrival of the spool at the actuated position, or a short time thereafter after any bounce has decayed. Further, this embodiment is microprocessor or single chip microcomputer controlled, so that depending upon the programming thereof injector valve control may be effected through the input to the processor of a control signal such as that illustrated in FIG. 10, or at the other extreme, may itself be used to control injector operation (injection timing and duration) of one or more, typically multiple cylinder injection valves based on basic parameter inputs thereto such as engine speed and "throttle" setting as well as secondary inputs if desired such as engine temperature, atmospheric conditions, etc. In that regard, the circuit of FIG. 14 illustrates a control circuit for a single injector valve, though obviously aspects of the circuit can be replicated for multiple valve applications using other processor or microcomputer output lines for the control thereof.

The circuit illustrated in FIG. 14 utilizes the same solenoid coil connections as the circuit of FIG. 12, namely that shown in FIG. 13. In the embodiment shown, an intel 8751 single chip computer 400 operating under program control is used. The clock for the computer is referenced to an external crystal oscillator comprising crystal X1 and capacitor C1 and C2. Also, the RC circuit comprising resistor 2 and capacitor 3 provides the appropriate reset pulse on start-up of the computer. The specific embodiment shown is intended to operate in response to the control signal of FIG. 10 applied to the J1 connector lead J1-3. That input signal on line 208, normally held low by pull-down resistor R1, is inverted twice by NAND gates 402 and 404 to apply the signal at appropriate signal levels to one lead of one of the ports of the computer configured as an input port for that purpose. Two leads of another port configured as an output port provide signals on lines 406 and 408 to control voltage translation devices 410 and 412, respectively, which in turn turn on and off power n-channel devices Q1 and Q3, respectively, to provide the desired current pulses to solenoid coils 200' and 202', respectively.

To describe the operation of the circuit of FIG. 14, assume for the moment that the control signal of FIG. 10 is low, that both power n-channel devices Q1 and Q3 have been off for a sufficient length of time for any current pulses in the respective solenoid coil to have reduced to zero, and that the valve spool is latched at the position last powered by solenoid coil 202' In this state, the processor will hold line 406 low, holding power n-channel device Q1 off, line 408 low, holding power n-channel device Q3 off, and lines 414 and 416 high to hold transistors Q7 and Q10 on, respectively. In that regard, the circuit comprised of resistor R5, transistors Q7 and Q6, resistors R3, R4 and R6, and power n-channel device Q5 functionally duplicates the circuit of FIG. 12 comprising resistor R23, transistors Q6 and Q5, resistors R22, R21, R10 and R32, and power n-channel device Q4 of FIG. 12, providing the snap action hereinbefore described. As described, this snap action allows the previously actuated solenoid to initially hold the valve spool until the newly actuated solenoid achieves a relatively high force level, at which time the spool will be released, thereby improving the speed of operation of the valve and repeatability with time and unit to unit. In the circuit of FIG. 12, snap action was provided in only one valve actuation direction, whereas in FIG. 14 the circuit which provides snap action is duplicated so as to be provided on each solenoid coil, thereby providing snap action in both directions, the timing and the release being set under program control by the processor or single chip computer. For providing the same holding action on solenoid coil 202', the circuit is duplicated by resistor R15, transistors Q10 and Q9, resistors R14, R7 and R22, and power n-channel device Q8.

When the control signal on line 208 (FIG. 14) goes high indicating injection is to begin, the processor pulls the voltage on line 406 high and the voltage on line 416 low. Pulling line 406 high turns on power n-channel device Q1, pulling one end of solenoid coil 200' low, thereby applying substantially full battery voltage thereacross. At the same time of course, line 416, being pulled low, allows pull-up resistor R22 to turn on power n-channel device Q8 until the current therethrough builds to the point that one VBE is applied to transistor Q9 to partially turn on the same and limit the gate voltage of power n-channel device Q8 to limit the current therethrough as previously described with respect to the corresponding circuit of FIG. 12. Then, very shortly thereafter, the processor drives the voltage on line 416 low again, turning on transistor Q10 and turning off power n-channel device Q8 to initiate valve spool motion. At this point, even though the holding current in coil 202' rapidly decays, there is still a substantial field strength in the respective magnetic parts of the solenoid because of the absence of a non-magnetic gap in the respective magnetic circuit. Thus, the field starts to diminish, generating a voltage across coil 202' equal to $$N\frac{d\phi}{dt}.$$

As the valve spool begins to move, the rate of collapse of the field in what had been the holding solenoid is accelerated because of the existence of an increasing non-magnetic gap in the respective magnetic circuit. This field collapse continues at an increased rate because of the increasing speed of the valve spool, until the valve spool is stopped at the extreme it was to travel. During most of the spool travel, the current in coil 202' will have fallen to substantially zero, the impedance of the circuits connected in parallel to solenoid coil 202' being relatively high. Consequently, the voltage generated in coil 202' is due primarily to two factors: one, the collapse of the field of the magnetic circuit surrounding coil 202' because of the increasing non-magnetic gap in that solenoid's magnetic circuit and, two, some coupling of the magnetic field from the opposite solenoid excitation. Generally speaking, the coupling from the excitation of the opposite solenoid will be relatively low, particularly as the spool approaches the end of its travel because of the now small and decreasing magnetic gap in the excited solenoid and the relatively large nonmagnetic gap in the solenoid having a substantially open coil. When the valve spool stops at its final position, what small residual magnetic field remains in the non-excited solenoid becomes stable so that the rate of change of field strength through coil 202' suddenly slows tremendously.

The net result of the foregoing is that once current is terminated in the holding solenoid to initiate the snap action of the valve spool toward the other solenoid, the back EMF in the solenoid coil of what had been the holding solenoid may be sensed to provide an accurate indication of the arrival of the valve spool at a fully actuated position, which in turn may be used to terminate the excitation to the driving solenoid coil. The net effect of this is that all variables may be automatically accounted for, including unit to unit variations, battery voltage variations, temperature variations, etc. by determining the actual arrival of the valve spool at the fully actuated position without any excessive drive on the actuating solenoid coil which would result in unnecessary power consumption and heating of the spool valve.

Figure 15:
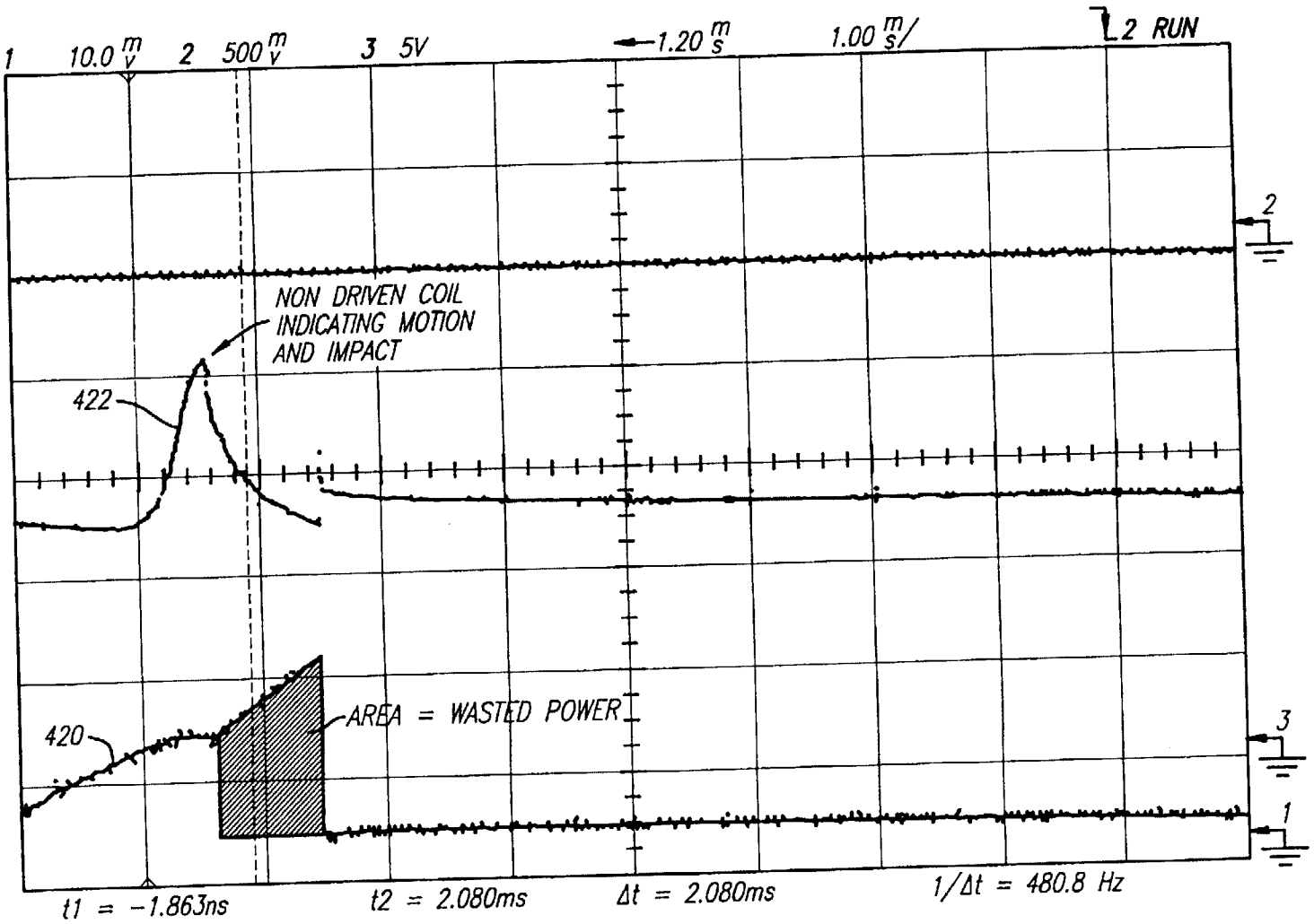
FIG. 15 is a copy of a strip chart showing the current waveform in an actuated solenoid and the back EMF measured on the coil of the solenoid which had previously been latched in accordance with the present invention.
Figure 16:
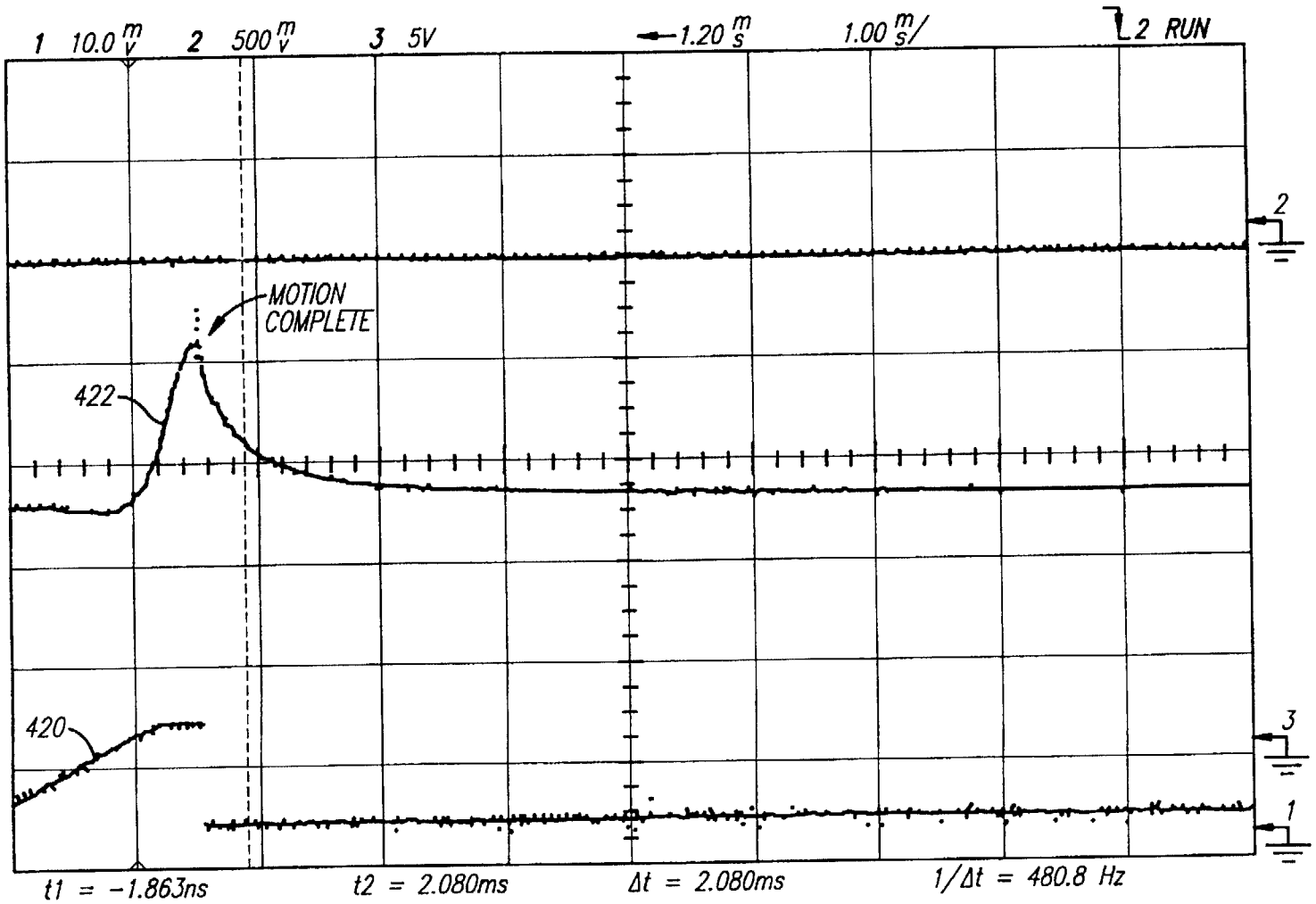
FIG. 16 is a copy of a strip chart showing the current waveform in an actuated solenoid and the back EMF measured on the coil of the solenoid which had previously been latched in accordance with the present invention for an embodiment wherein the current pulse is terminated upon arrival of the spool valve at the actuated position.

Referring now to FIG. 15, a strip chart showing the current waveform 420 in an actuated solenoid and the back EMF 422 measured on the coil of the solenoid which had previously been latched may be seen. As the current 420 initially rises, the spool remains in the latched position. Once the spool pulls away from the latched position and begins moving, an increasing back EMF 422 is generated in the coil of what had been the latched solenoid. That back EMF continues to increase until it reaches a peak at the time of arrival of the spool in the new latched position, at which time the back EMF rapidly decreases. In the curve shown in FIG. 15, the peak in the back EMF 422 was used to terminate the drive voltage and thus current 420 in the excited solenoid, though even if the current 420 was continued thereafter for a period, the decaying back EMF once the valve spool reaches the new latch position will still be similar to that shown in FIG. 15. Accordingly, the peak in the back EMF curve 422 may be used as a direct indication of the arrival of the spool at the new latched position, with the current pulse to the other solenoid being terminated at that time, or preferably a short time thereafter to allow for the settling of any bounce of the spool at its new position.

The peak in the back EMF of solenoid coil 200' of solenoid 140 (FIG. 4) is sensed by the circuit comprising capacitors C4, C5 and C3, resistors R8, R9, R10, R11, R12, R13 and variable resistor R23, comparators 440 and 442, NAND gate 444 and diodes D1 through D4. In that regard, diodes D1 and D2 clamp the positive input to comparator 440 to a voltage range of no less than one forward conduction diode voltage drop below circuit ground to no more than one forward conduction diode voltage drop above the five volt power supply. Diodes D3 and D4, on the other hand, limit the voltage range of the negative input of comparator 442 to one forward conduction diode voltage drop below circuit ground to one forward conduction diode voltage drop above circuit ground. Both of these voltage ranges extend beyond the voltage range of the opposite input to the respective comparator, and accordingly the diodes do not affect the inputs to the comparators around their switching point.

When the back EMF of solenoid coil 200' is low or substantially zero and substantially unchanging, capacitor C5 will discharge through resistors R9 and R10 so that the positive input to comparator 440 will be substantially at ground. The negative input, on the other hand, will be at some voltage above ground by an amount dependent upon the adjustment of variable resistor R23. Accordingly, the output transistor of the comparator 440 will be turned on, holding the output of the comparator low against the pull-up resistor R12. This assures that one input to NAND gate 444 is low, making the output of the NAND gate 444 high independent of the other input thereto, which output is coupled back to the processor or single chip computer 400 as an input signal thereto.

When the back EMF of coil 200' starts rising as the valve spool starts pulling away from the respective solenoid, capacitor C3 couples the rising voltage through resistor R8 to the negative input of comparator 442, assuring now that the output of comparator 442 is held low, thereby assuring that the output of NAND gate 444 remains held high irrespective of the output of comparator 440. As the back EMF continues to rise, capacitor C4 couples the rising back EMF to the positive input of comparator 440, capacitor C5 being a relatively small capacitor primarily for noise suppression purposes. When the positive input to comparator 440 exceeds the negative input to the comparator, signifying that the back EMF has increased at an adequate rate and level to clearly indicate spool motion, the output transistor of comparator 440 will be turned off, allowing resistor R11 to pull the respective input to NAND gate 444 high. The output of the NAND gate still remains high, however, because of the still low second input to the NAND gate. At the same time, the negative input to comparator 442 rises somewhat also, the extent of the rise being limited in any event to one forward conduction diode voltage drop of diode D4, and is further limited dependent upon the rate of increase of the back EMF by resistor R8 which is a substantially lower valued resistor than resistor R13. Because of the relatively low value of resistor R8, the combination of capacitor C3 and resistor R8 act as a differentiator in the frequency range of interest, holding the negative input to comparator 442 above ground when the back EMF is increasing, but pulling the same negative when the back EMF goes over the top of the curve shown in FIG. 15 and begins any decrease, thereby acting as a peak detector.

When the back EMF does go over the top and decreases at all, capacitor C3 will pull the negative input to comparator 442 low, turning off the output transistor of comparator 442 and allowing pull-up resistor R11 to pull the second input of NAND gate 444 high. Assuming the rise in the back EMF has been fast enough and high enough to properly indicate spool motion as herein before described, both inputs to NAND gate 442 will be high immediately after the back EMF has peaked, thereby driving the output of NAND gate 444 low to signal the processor or single chip computer that spool motion has been sensed and that the spool has arrived at the extreme of its travel. The processor may then use this signal to turn off the actuating current pulse on coil 202' by driving the voltage on line 408 low, either immediately after sensing the arrival of the valve spool at the fully actuated position as in FIG. 15, or alternatively a short time thereafter to allow for any bounce to settle to assure proper latching by way of the retentivity of the magnetic materials.

The circuit just described is replicated for the solenoid coil 202' by capacitors C6, C7 and C8, resistors R16, R17, R18, R19, R20, R21 and variable resistor R24, diodes D5 through D8, comparators 446 and 448 and NAND gate 450. Accordingly, the circuit of FIG. 14 provides snap action in both directions of motion of the spool valve, and actual sensing of the spool motion so that each actuating current pulse may be quickly yet reliably terminated upon arrival off the valve spool at the newly actuated position to minimize heating in the solenoids independent of operating conditions and parameters, thereby allowing a small solenoid valve and a high operating current pulse to minimize the operating time for the spool valve without substantial heating and particularly overheating of the relatively small solenoid coils.

Note that not only does the processor or single chip computer 400 control the various aspects of the operation of the spool valve, but that it essentially monitors the operation thereof also. Accordingly, the computer may also accomplish other tasks. By way of example, if the spool has any tendency to stick, the computer can recognize the lack of arrival of the spool at an actuated position within a predetermined maximum time period and shut off the current pulse even though the valve has not yet responded, thereby avoiding overheating and possible burnout of the solenoid coil. It can also sense the repetition of such an occurrence and temporarily or permanently stop attempting to actuate the spool valve pending replacement of the spool valve or entire injector. If a single computer is being used to control a plurality of injector spool valves through the various lines of the various ports of the computer, the computer can obviously identify the offending valve. Further, since the computer knows when it initiated a solenoid actuating current pulse, and the computer is again signaled when this spool motion is complete, the computer can determine the length of time it took for the actuation, and compare that time to a standard time for present operating conditions, or monitor the short term variations in the length of actuation time of each spool valve controlled by the computer. This can be important, in that significant short term variations in the actuation time of a spool valve are suggestive of a deterioration in performance due to contamination, corrosion, or other factors which, if not corrected, could lead to an outright valve failure, as temperature, battery voltage, etc., should not have a short-term effect on the spool valve. Accordingly, the computer can maintain performance statistics which can be interrogated and used at the time of planned engine maintenance to avoid the necessity of later unplanned maintenance.

Figure 17:
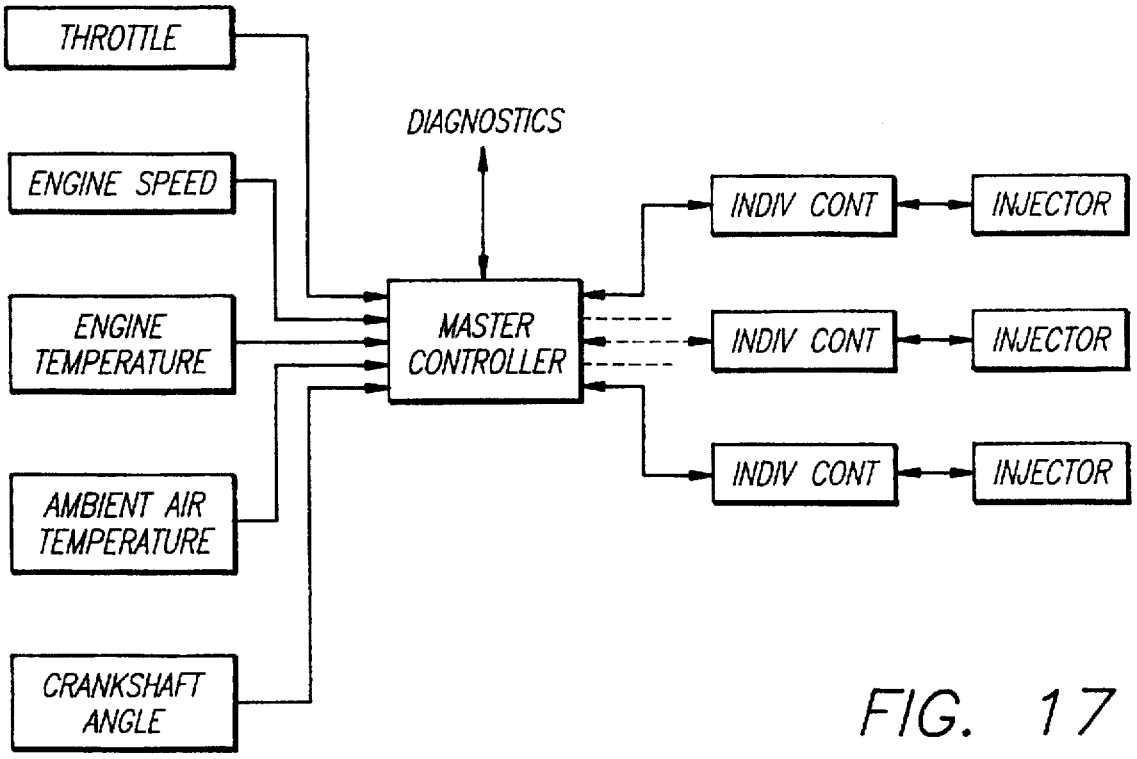
FIG. 17 is a block diagram of one embodiment of fuel injection system in accordance with the present invention.

Now referring to FIG. 17, a block diagram of one embodiment of fuel injection system in accordance with the present invention may be seen. This fuel injection system, primarily intended for multiple cylinder engines, utilizes a master controller responsive to various inputs to provide control signals to individual controllers which in turn control an associated injector. In a typical system, the master controller would normally be responsive to such inputs as the throttle setting, the engine speed, engine temperature, ambient air temperature and crankshaft position to establish the timing of the start and duration of injection for each cylinder. In such a system, the master controller would provide control signals generally in the form shown in FIG. 10, with individual controllers of the general type illustrated in FIG. 12, or other embodiments described herein or variations thereof, being responsive to the control signal to control the associated injector. If, by way of specific example, the controller in accordance with FIG. 12 is used for the individual controllers, the entire controller may be mounted on the injector, or as a first alternative, the power drive electronics may be mounted on the injector (or spool valve therefor) with the single chip computer being mounted in a separate control box controlled by the master controller. Also, as indicated in the figure, while the master controller controls the individual controllers which in turn control the respective injectors, the injectors may in turn feed back information to the individual controllers with respect to the required time of actuation for the spool valve therein. The individual controllers may use the time of actuation for the spool valves to accumulate statistics on injector operation for communicating back to the master controller, which may be interrogated through a diagnostics port on the master controller either continuously for display or recording, or periodically at the time of scheduled engine service. Alternatively, of course, the individual controller could merely pass on these spool valve operating time periods to the master controller, with the statistics thereon being determined and maintained at the master controller for diagnostic purposes.

The advantage of the configuration of FIG. 17 is that the individual controllers operate from a control signal waveform which is the same as the normal drive to prior art solenoid actuated injector valves wherein the solenoid is excited for the full duration of the valve injection period. While the normal drive for a prior art solenoid valve would normally be of a higher voltage, the waveform could be easily clipped, limited or otherwise translated to the input voltage range of a single chip computer or other drive circuit being used, so that injectors with individual controllers could potentially be used in direct substitution of prior art solenoid operated injection valves. Such a system would not have the diagnostics capabilities hereinbefore explained unless the controller of the prior art was also replaced by a corresponding controller in accordance with the present invention, either when the injectors were replaced or at any appropriate later time as desired. In that regard, note that the speed of injection and particularly the speed with which injection can be terminated is not dependent upon the master controller, but rather the individual controllers and the injectors, so that replacement of prior art solenoid operated injectors with the injectors and individual controllers of the present invention without changing the central controller should still result in increased fuel economy and lower emissions from the engine.

Figure 18:
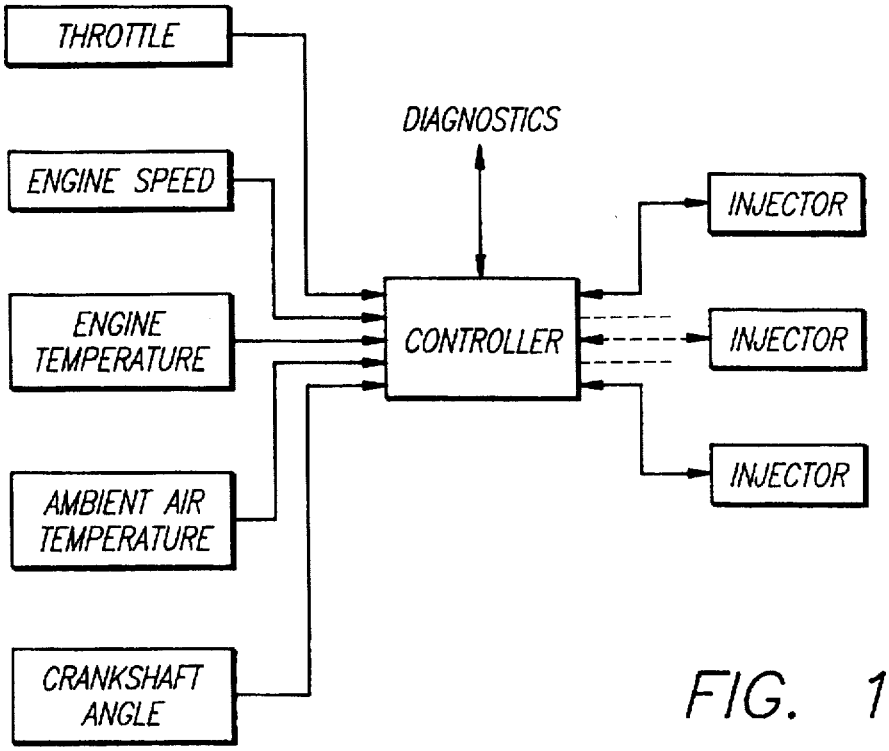
FIG. 18 is a block diagram of an alternate embodiment of fuel injection system in accordance with the present invention.

In the case of new engines and engines wherein the entire fuel injection system may be changed, a single more powerful central controller may be used as shown in FIG. 18. Here a single central computer monitors the various parameters determining injection time and duration and controls the drive electronic for the spool valves of the individual injectors, the spool valves in turn providing their own performance data back to the controller for display through a diagnostic system and/or later retrieval by the diagnostic system.

Referring again to FIG. 3 and the description relating thereto, the advantages of the small pre-injection preceding the main injection have been described. The present invention allows such pre-injection by appropriate programming of the computer controlling the spool valves on each injector. In particular, FIG. 11 shows the current pulse in one coil to actuate the spool valve and latch the same so as to initiate injection, and the current pulse in the opposite coil to return the spool valve to the original position and latch the same to terminate injection. These current pulses, however, can be closely spaced in time, or even be somewhat overlapping, to have an initial very short injection period, then followed by the full injection cycle again to provide the pre-injection followed by normal injection. Further, the current pulse to initiate pre-injection may be intentionally shortened so that full spool valve motion to initiate injection is not achieved before excitation of the opposing solenoid coil. In that regard, it should be noted that, as previously described, controllers of the present invention may sense the time required for full actuation of the spool valve, either as measured from the beginning of the actuating pulse, or in the case of snap action, from the termination of the holding current allowing release of the spool valve to initiate actuation. This time of spool valve actuation may be measured during the normal injection cycle (as opposed to during pre-injection). While this measured time will vary dependent upon battery voltage, individual coil resistance, temperature, etc., the time for full travel of the spool valve to initiate injection effectively integrates the effect of all such variables. Further, the general shape of the curve of spool valve position versus time during actuation will be fixed, even though the time base may be stretched or compressed dependent upon battery voltage, etc. Consequently, one can determine the current actuation pulse to cause less than full spool valve motion for pre-injection as a percentage of the full normal injection current pulse as a design parameter of the injection system, and then apply that predetermined percentage to the last full injection cycle to determine the current pulse for the next pre-injection cycle. In this way, a carefully tailored pre-injection cycle may be achieved in spite of variations of temperature, battery voltage, etc., as such variations will be or can be made small (capacitive filtering of battery voltage, etc.) between one injection cycle and the next pre-injection cycle.

Battery voltage in a properly operating engine system will remain within reasonable limits, and the present invention is particularly tolerant of battery voltage variations because of its ability to terminate the spool valve actuating current pulse as soon as spool valve motion is complete and latching has been achieved. However battery voltage during engine starting can drop drastically, though good control of injection during starting of an engine, particularly a cold engine, is still desired. Accordingly, for this purpose, a boost voltage circuit may be utilized when the battery voltage drops below some predetermined voltage, such as below a normal operating voltage indicative of the operation of the starter motor.

For this purpose, as shown in FIG. 19, a low voltage detection circuit is connected to the battery supply line for the injection system. Thus, when the battery voltage as supplied to the injection system falls below some predetermined limit such as, by way of example, 10 or 11 volts in a 12 volt (typically 12.6 volt) system, or perhaps 22 volts in a 24 volt system, the output of the low voltage detection circuit will enable the operation of a step-up switching regulator which in turn provides a stepped up and regulated output voltage VOUT to a valve supply switching circuit. Step-up switching regulators in general provide a constant output voltage VOUT independent of the input voltage, and are capable of proper operation from a small step-up in voltage to stepping up of the input voltage thereto by a substantial multiple. In that regard, one of the advantages of the present invention is the fact that the average power required for actuation of the spool valves is relatively low, a very small fraction of that required by prior art solenoid controlled injection valves, so that the power capabilities required of the step-up switching regulator used with the present invention is relatively modest, particularly considering that the same may be operating the fuel injectors for a relatively large diesel engine.

A full circuit of the type shown in FIG. 19 may be seen in FIG. 20. Here, a current supplied by resistor 500 through a voltage source 502 is provided as the positive input to comparator 504. Voltage source 502 may be a zener diode or other voltage source as are readily commercially available. The negative input to comparator 504 is provided by voltage divider comprising resistors 506 and 508. In operation, voltage source 502 holds the positive input to the comparator at the voltage of the voltage source. If the battery voltage is sufficiently high, the divided down voltage on the negative input to the comparator 504 will still be higher than the voltage of voltage source 502 to hold the output of the comparator on line 510 low. As the battery voltage decreases, voltage source 502 will hold the positive input to the comparator at the voltage of the voltage source, whereas the voltage on the negative input will decrease in proportion to the decrease in the battery voltage until finally the positive input to the comparator 504 is higher than the negative input, driving the output of the comparator on line 510 high. If the battery voltage drops below the voltage of voltage source 502, the voltage source will shut off. Now the voltage on the positive input to the comparator will be substantially equal to the battery voltage, though the negative input to comparator 504 will be a voltage divided down from the battery voltage, so that the positive input to the comparator is still higher than the negative input, so that the comparator still holds line 510 high.

The voltage from line 510 provides an enable signal to the switching step-up regulator 512, in the embodiment shown a pulse width modulation switching regulator integrated circuit. (Switching regulators of various types, including pulse width modulation and frequency modulation regulators, are well known in the prior art of electronics and need not be described further herein). The output of the pulse width modulation switching regulator integrated circuit is coupled through line 514 to the base of transistor 516. When the pulse width modulator 512 is enabled as a result of low battery voltage, the output of the pulse width modulator 512 will turn transistor 516 on and off at a constant frequency, but with a duty cycle as required to maintain the voltage on line 518 at the predetermined desired level as sensed by the feedback on line 520 to the pulse width modulator. In particular, when transistor 516 is turned on, the current in inductor 522 rises linearly, building up energy in the magnetic field of the inductor. When transistor 516 is turned off, the back EMF of inductor 522 forward biases diode 524 to provide a charging current pulse to capacitor 526 which in turn delivers current to the valves through diode 528. If the electrical load on such a system is relatively low, transistor 516 will be turned on with a relatively low duty cycle, so that little energy builds in inductor 522 before the transistor is turned off. As this energy is delivered to capacitor 526 through diode 524, the current in inductor 522 will again fall to zero, diode 524 thereafter preventing reverse current flow from the output back to the battery. On the other hand, if the electrical load on the system is relatively high, transistor 516 may be turned on with a much higher duty cycle so that when transistor 516 is turned off, a higher current pulse is delivered to capacitor 526 through diode 524, with transistor 516 being turned on again to again replenish the energy in the inductor even before the inductor current falls to zero.

Because of the low energy requirements of the solenoids of the present invention, switching regulators of a reasonable size may be used to step up a battery terminal voltage of only a few volts to the full desired operating voltage of the system. This assures performance of the injection system at any battery voltage adequate to turn over the engine for starting purposes. Of course, when the battery voltage in the circuit of FIG. 20 is sufficiently high, the negative input to comparator 504 will exceed the positive input thereto, driving the enable voltage on line 510 low to turn off the pulse width modulator 512. This holds transistor 516 off, with the battery power being supplied through diode 530 to operate the valves. In this condition the current through inductor 522 will be zero, as the forward conduction voltage drop of diode 520 will be less than the forward conduction diode voltage drop required by the two diodes 524 and 528.

While the present invention valves and control systems therefore have been described with respect to fuel injection applications, and then with respect to certain exemplary types of fuel injectors, it should be noted that other types of fuel injectors may be used, and the invention is also highly useful in applications other than fuel injection, particularly where high speed, small size, low power consumption or high reliability through self monitoring capabilities are desired. In the claims to follow, the word microprocessor is used in the general sense to refer to what are sometimes referred to as microprocessors, microcontrollers and single chip computers. Thus while certain exemplary embodiments have been described and shown in the accompanying drawings, it is to be understood that such embodiments are merely illustrative of and not restrictive on the broad invention, and that this invention not be limited to the specific constructions and arrangements shown and described, since various other modifications may occur to those ordinarily skilled in the art.

I claim:

1. A fuel injection system comprising:

a fuel injector;

an injector valve member for coupling to a source of fluid under pressure, the injector valve member being coupled to the fuel injector;

a first solenoid coil for magnetically moving the valve member to a first position for causing fuel injection by the fuel injector responsive to an actuating current in the first solenoid coil;

a second solenoid coil for moving the valve member to a second position for stopping fuel injection by the fuel injector responsive to an actuating current in the second solenoid coil;

an electronic control system coupled to the first and second solenoid coils for providing current to the first and second solenoid coils to control the position of the valve member to initiate and terminate fuel injection by the injector, the control system including a sensing circuit coupled to one of the solenoid coils for sensing the valve member reaching the position caused by the current in the other solenoid coil and for terminating the current in the respective one of the solenoids responsive thereto.

2. The fuel injection system of claim 1 wherein the valve member is a spool valve member.

3. The fuel injection system of any one of claims 1 or 2 wherein the valve member tends to remain in the first position by residual magnetism as the current in the first solenoid coil reduces toward zero and in the second position by residual magnetism as the current in the second solenoid coil reduces toward zero.

4. The fuel injection system of claim 3 wherein the residual magnetism is at least in part the residual magnetism of the valve member.

5. The fuel injection system of claim 1 further comprised of means responsive to the actuation time between applying a current to a solenoid coil and the valve member reaching the position caused by the current in the respective solenoid coil for monitoring the variation in the actuation times for successive operating cycles of the fuel injection system.

6. The fuel injection system of claim 1 further comprised of a second sensing circuit coupled to the other of the solenoid coils for also sensing the valve member reaching the position caused by the current in the opposite solenoid coil and for terminating the current in the respective one of the solenoids responsive thereto.

7. The fuel injection system of any one of claims 1 or 6 wherein the electronic control system will temporarily provide a holding current to one of the solenoid coils to hold the valve member in its then present position as actuation current is applied to the other solenoid coil, then will terminate the holding current to release the valve member for actuation.

8. The fuel injection system of claim 7 wherein the electronic control system will temporarily provide a holding current to either of the solenoid coils to hold the valve member in its then present position as actuation current is applied to the other solenoid coil, and will terminate the holding current to release the valve member for actuation.

9. The fuel injection system of any one of claims 2, 5 or 6 wherein the electronic control system is microprocessor controlled.

10. The fuel injection system of claim 9 wherein the electronic control system includes sensors for responding to operating conditions of an engine, the microprocessor being responsive to sensors to control the position of the valve member to initiate and terminate fuel injection by the injector.

11. The fuel injection system of claim 9 wherein the electronic control system includes sensors for responding to environmental conditions, the microprocessor being responsive to sensors to control the position of the valve member to initiate and terminate fuel injection by the injector.

12. The fuel injection system of claim 9 wherein the electronic control system includes sensors for responding to operating conditions of an engine and environmental conditions, the microprocessor being responsive to the sensors to control the position of the valve member to initiate and terminate fuel injection by the injector.

13. A fuel injection system comprising:

a fuel injector;

an injector valve member for coupling to a source of fluid under pressure, the injector valve member being coupled to the fuel injector;

a first solenoid coil for magnetically moving the valve member to a first position for causing fuel injection by the fuel injector responsive to an actuating current in the first solenoid coil;

a second solenoid coil for moving the valve member to a second position for stopping fuel injection by the fuel injector responsive to an actuating current in the second solenoid coil;

an electronic control system coupled to the first and second solenoid coils for providing current to the first and second solenoid coils to control the position of the valve member to initiate and terminate fuel injection by the injector, the control system temporarily providing a holding current to one of the solenoid coils to hold the valve member in its then present position as actuation current is applied to the other solenoid coil, and then terminating the holding current to release the valve member for actuation.

14. The fuel injection system of claim 13 wherein the valve member is a spool valve member.

15. The fuel injection system of claim 14 wherein the valve member tends to remain in the first position by residual magnetism as the current in the first solenoid coil reduces toward zero and in the second position by residual magnetism as the current in the second solenoid coil reduces toward zero, in part by the residual magnetism of the valve member.

16. The fuel injection system of claim 13 further comprised of means responsive to the actuation time between applying a current to a solenoid coil and the valve member reaching the position caused by the current in the respective solenoid coil for monitoring the variation in the actuation times for successive operating cycles of the fuel injection system.

17. The fuel injection system of claim 13 wherein the electronic control system coupled to the first and second solenoid coils will temporarily provide a holding current to either of the solenoid coils to hold the valve member in an actuated position as actuation current is applied to the other solenoid coil, then will terminate the holding current to release the valve member for actuation.

18. The fuel injection system of claim 17 further comprising a sensing circuit coupled to one of the solenoid coils for sensing the valve member reaching the position caused by the current in the other solenoid coil and for terminating the current in the respective one of the solenoids responsive thereto.

* * * * *